US011008685B2

(12) United States Patent
Yamanashi et al.

(10) Patent No.: US 11,008,685 B2
(45) Date of Patent: May 18, 2021

(54) SEWING MACHINE AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya (JP)

(72) Inventors: Yoko Yamanashi, Konan (JP); Yukiyoshi Muto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 158 days.

(21) Appl. No.: 16/460,702

(22) Filed: Jul. 2, 2019

(65) Prior Publication Data

US 2020/0010992 A1 Jan. 9, 2020

(30) Foreign Application Priority Data

Jul. 3, 2018 (JP) ..... JP2018-126871

(51) Int. Cl.
*D05B 19/12* (2006.01)
*D05B 19/08* (2006.01)
(Continued)

(52) U.S. Cl.
CPC ..... *D05B 19/12* (2013.01); *D05B 19/08* (2013.01); *D05B 19/10* (2013.01); *D05B 35/12* (2013.01); *D05C 5/02* (2013.01)

(58) Field of Classification Search
CPC ..... D05B 16/00; D05B 19/16; D05B 35/00; D05B 35/12; D05B 39/00; D05B 21/00; D05C 5/00; D05C 5/06
See application file for complete search history.

(56) References Cited

U.S. PATENT DOCUMENTS 4,309,950 A * 1/1982 Franklin ..... D05B 21/00 112/103
4,932,345 A * 6/1990 Takenoya ..... D05B 19/10 112/103
(Continued)

FOREIGN PATENT DOCUMENTS

JP 2003-126576 A 5/2003
JP 2004-089725 A 3/2004
(Continued)

*Primary Examiner* — Ismael Izaguirre
(74) *Attorney, Agent, or Firm* — Oliff PLC

(57) ABSTRACT

A controller of a sewing machine obtains a rectangular frame embroidery pattern and obtains a first unit pattern to be laid out in each of four corner portions of the embroidery pattern and a second unit pattern to be repeatedly laid out in each of side portions of the embroidery pattern. The controller determines, based on the size of the embroidery pattern, the number of repeats of the second unit pattern in a target side portion. The controller generates pattern data for the embroidery pattern including the first unit pattern being laid out in each corner portion and the second unit pattern being laid out in the target side portion as many as the determined number of repeats of the second unit pattern. The controller causes the sewing machine to form the embroidery pattern on a workpiece held by an embroidery hoop based on the generated pattern data.

14 Claims, 12 Drawing Sheets

(51) Int. Cl.

| | |
|---|---|
| ***D05B 35/12*** | (2006.01) |
| ***D05B 19/10*** | (2006.01) |
| ***D05C 5/02*** | (2006.01) |

(56) References Cited

U.S. PATENT DOCUMENTS

| | | | | |
|---|---|---|---|---|
| 5,782,189 | A * | 7/1998 | Hirata | G05B 19/106 112/102.5 |
| 5,865,133 | A * | 2/1999 | Herbach | D05B 19/12 112/102.5 |
| 5,960,727 | A * | 10/1999 | Miyasako | D05B 19/105 112/102.5 |
| 6,357,370 | B1 * | 3/2002 | Fritz | A41H 3/06 112/117 |
| 6,600,966 | B1 * | 7/2003 | Bailie | D05B 19/10 112/102.5 |
| 2007/0213865 | A1 * | 9/2007 | Mizuno | D05B 19/10 700/138 |
| 2010/0224112 | A1 * | 9/2010 | Kahn | D05C 13/02 112/475.19 |
| 2010/0242817 | A1 | 9/2010 | Tokura | |
| 2016/0010252 | A1 * | 1/2016 | Yamanashi | D05B 19/12 700/138 |
| 2016/0160414 | A1 | 6/2016 | Oda et al. | |

FOREIGN PATENT DOCUMENTS

| | | | |
|---|---|---|---|
| JP | 2005-087285 | A | 4/2005 |
| JP | 2010-246885 | A | 11/2010 |
| JP | 2016-106860 | A | 6/2016 |

* cited by examiner

CR
LR
E3
62
61
60

CR
LR
E4
62
CL
61
60

CR
EP2,SP2
61
LR
E5
62
60
60

EP2,SP2
LR
E6
CL
62
61
60

CL
LR
E7
CL
62
61
60

SEWING MACHINE AND NON-TRANSITORY COMPUTER-READABLE MEDIUM STORING COMPUTER-READABLE INSTRUCTIONS

CROSS-REFERENCE TO RELATED APPLICATION

This application claims priority from Japanese Patent Application No. 2018-126871 filed on Jul. 3, 2018, the content of which is incorporated herein by reference in its entirety.

TECHNICAL FIELD

Aspects described herein relate to a sewing machine and a non-transitory computer-readable medium storing computer-readable instructions.

BACKGROUND

For forming, on a workpiece, a border pattern in which the same unit pattern is repeated in a line, a known sewing machine displays markers on a display as well as one or more unit patterns. The markers are used for positioning a unit pattern relative to another unit pattern. The markers are located at arbitrary positions relative to a unit pattern. A user adjusts relative positions between unit patterns with reference to the markers.

SUMMARY

For generating pattern data for forming, on a workpiece, a rectangular frame embroidery pattern in which a unit pattern having an arbitrary size is repeated, the user may lay out the unit pattern repeatedly in each side portion of the rectangular frame embroidery pattern with reference to the markers, which may be a complicated and difficult operation.

Accordingly, some embodiments of the disclosure provide for a sewing machine and a non-transitory computer-readable medium storing computer-readable instructions, each of which may implement generation of pattern data for forming, on a workpiece, a rectangular frame embroidery pattern in which unit patterns having respective arbitrary sizes are laid out, with more simple operation as compared with a known operation.

According to one or more aspects of the disclosure, a sewing machine includes a sewing unit, a moving unit, and a controller. The sewing unit includes a needle bar. The sewing unit is configured to move the needle bar up and down to form stitches on a workpiece. The moving unit includes an attachment unit to which an embroidery hoop holding the workpiece is detachably attached. The moving unit is configured to move the attachment unit relative to the needle bar. The controller is configured to control the sewing unit and the moving unit. The controller is further configured to perform size obtainment including obtaining a size of an embroidery pattern having a rectangular frame shape. The embroidery pattern includes four corner portions and four side portions. Each of the side portions is positioned between two of the corner portions. The controller is further configured to perform pattern obtainment including obtaining a first unit pattern and a second unit pattern. The first unit pattern is to be laid out in each of the corner portions. The second unit pattern is to be laid out in each of the side portions. The controller is further configured to perform repeat number determination including determining, based on the size of the embroidery pattern obtained in the size obtainment, the number of repeats of the second unit pattern in a target side portion. The target side portion is one of the side portions. The controller is further configured to perform pattern data generation including generating pattern data for the embroidery pattern to be embroidered. The embroidery pattern includes the first unit pattern being laid out in each of the corner portions and the second unit pattern being repeatedly laid out in the target side portion as many as the number of repeats of the second unit pattern determined in the repeat number determination. The controller is further configured to perform embroidery control including controlling the sewing unit and the moving unit based on the generated pattern data, thereby forming the embroidery pattern on the workpiece held by the embroidery hoop.

According to one or more other aspects of the disclosure, a non-transitory computer-readable medium storing computer-readable instructions that, when executed by a computer, cause the computer to perform obtaining a size of an embroidery pattern having a rectangular frame shape. The embroidery pattern includes four corner portions and four side portions. Each of the side portions is positioned between two of the corner portions. The instructions cause the computer to perform obtaining a first unit pattern and a second unit pattern. The first unit pattern is to be laid out in each of the corner portions. The second unit pattern is to be laid out in each of the side portions. The instructions cause the computer to perform determining, based on the obtained size of the embroidery pattern, the number of repeats of the second unit pattern in a target side portion that is one of the side portions. The instructions cause the computer to perform generating pattern data for the embroidery pattern to be embroidered. The embroidery pattern includes the first unit pattern being laid out in each of the corner portions and the second unit pattern being repeatedly laid out in the target side portion as many as the determined number of repeats of the second unit pattern.

According to one or more aspects, the pattern data for the rectangular frame embroidery pattern to be embroidered may be generated by automatically adjusting a layout of the first unit pattern and the second unit pattern in accordance with the size of the embroidery pattern. Thus, the sewing machine and the computer may generate pattern data for a rectangular frame embroidery pattern to be embroidered having an arbitrary size in which unit patterns are laid out, with more simple operation as compared with a known operation. Consequently, the sewing machine may form the embroidery pattern on the workpiece held by the embroidery hoop based on the generated pattern data.

DETAILED DESCRIPTION

Figure 1:
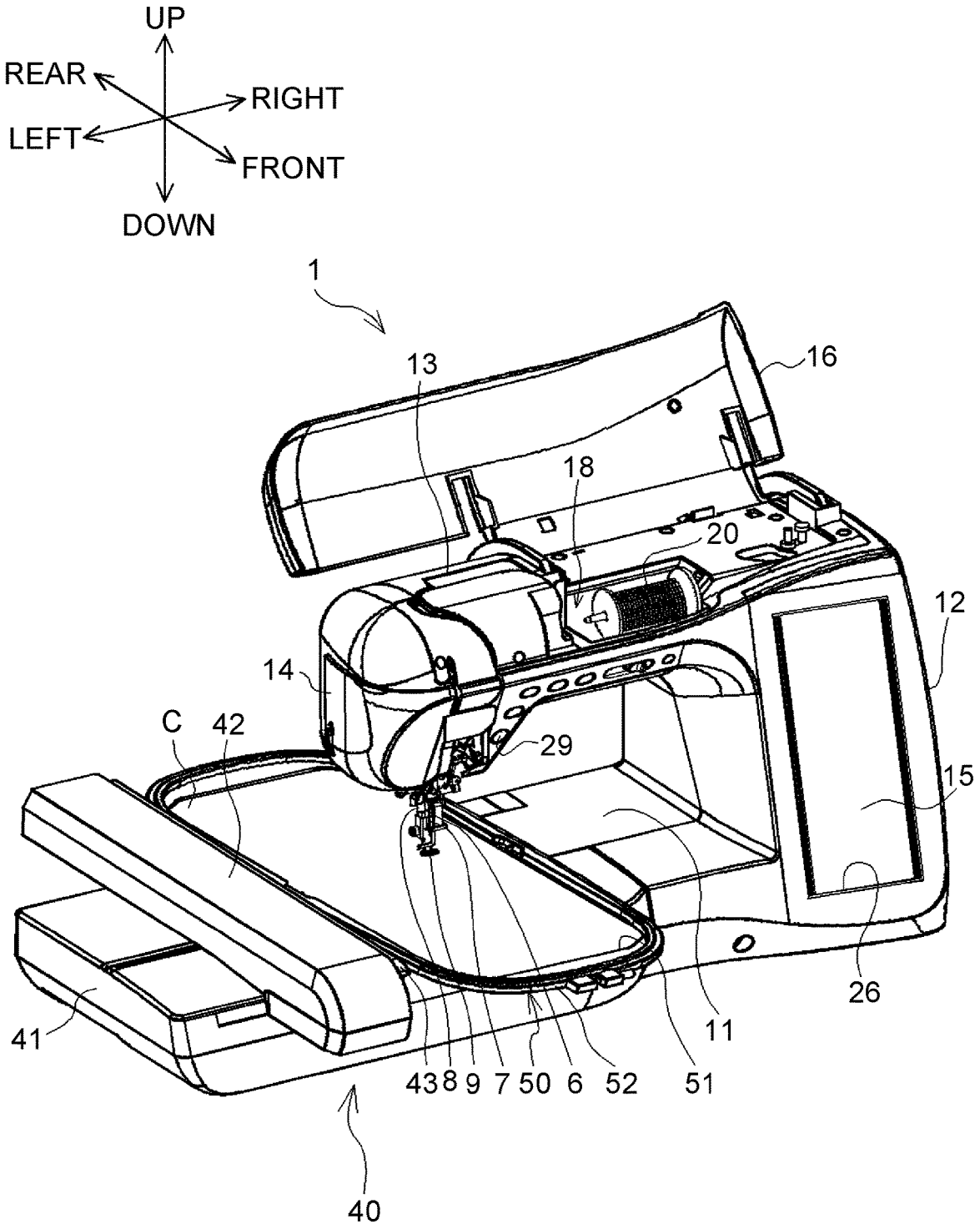
FIG. 1 is a perspective view of a sewing machine to which a holder moving unit is attached in an illustrative embodiment according to one or more aspects of the disclosure.
Figure 2:
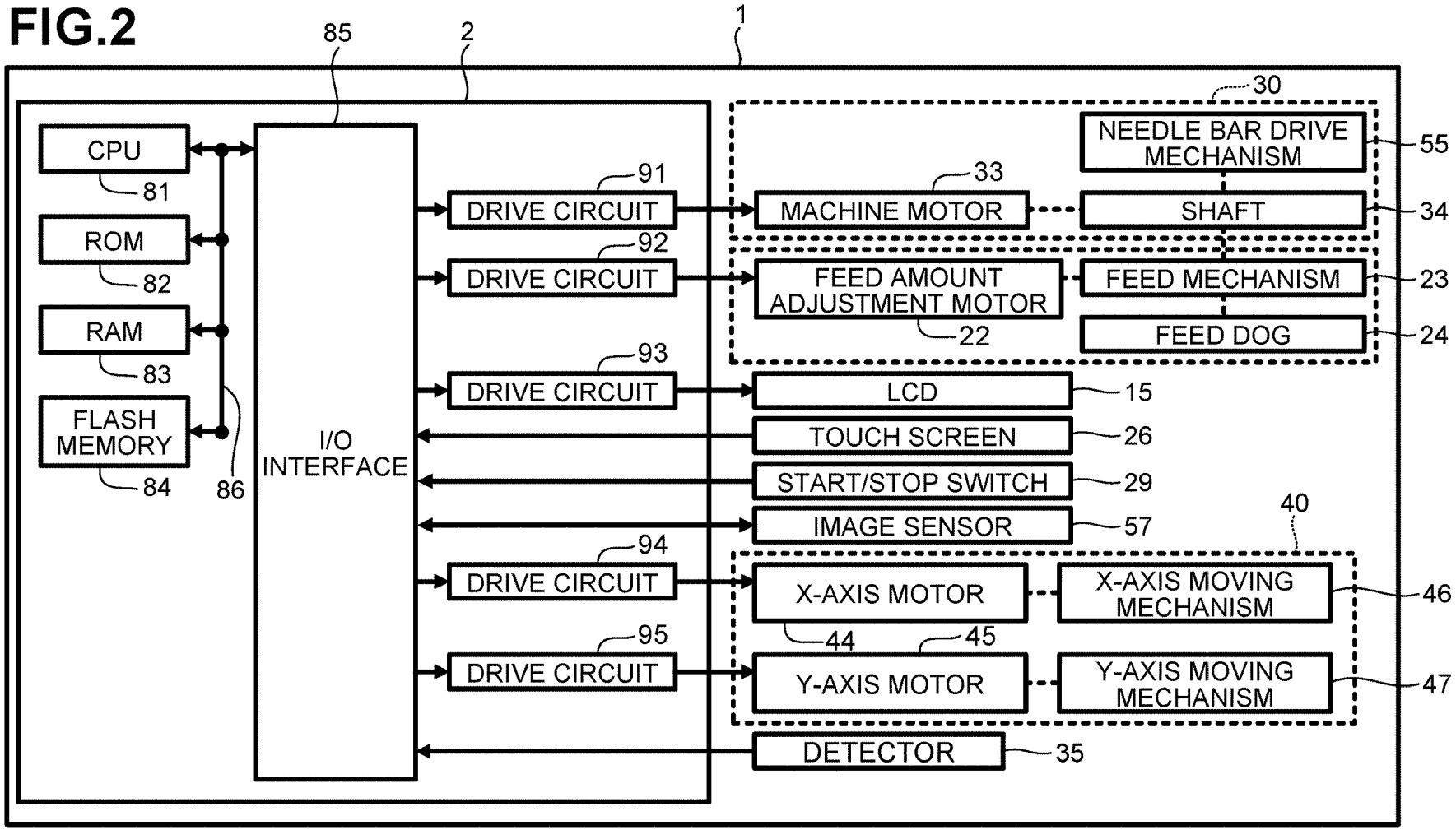
FIG. 2 is block diagram illustrating an electrical configuration of the sewing machine in the illustrative embodiment according to one or more aspects of the disclosure.

An illustrative embodiment will be described with reference to the accompanying drawings. Referring to FIGS. 1 and 2, a configuration of a sewing machine 1 to which a holder moving unit 40 is attached will be described. In the following description, directional terminology, such as "up/upper," "down/lower," "front," "rear," "left," "right" etc., as labeled in the drawings, may be used. In the page of FIG. 1, an upper side, a lower side, a lower right side, an upper left side, a lower left side, and an upper right side respectively correspond to an upper side, a lower side, a front side, a rear side, a left side, and a right side of the sewing machine 1 to which the holder moving unit 40 is attached. A longitudinal direction of a bed 11 and a horizontal arm 13 corresponds to a left-right direction of the sewing machine 1. A side of the sewing machine 1 on which an upright arm 12 is disposed is the right side. A direction in which the upright arm 12 is elongated is an up-down direction of the sewing machine 1.

As depicted in FIG. 1, the sewing machine 1 includes the bed 11, the upright arm 12, the horizontal arm 13, and a head 14. The bed 11 is a base portion of the sewing machine 1, and extends in the left-right direction. The upright arm 12 extends upward from a right end portion of the bed 11. The horizontal arm 13 extends leftward from an upper end of the upright arm 12 and faces the bed 11. The head 14 is connected to a left end portion of the horizontal arm 13.

The sewing machine 1 further includes a feed dog 24 (refer to FIG. 2), a feed mechanism 23 (refer to FIG. 2), and a shuttle mechanism that are housed in the bed 11. The feed mechanism 23 is configured to drive the feed dog 24 to feed a workpiece by a predetermined amount in sewing. The shuttle mechanism causes an upper thread to be entwined or intertwined with a lower thread underneath a needle plate disposed at an upper surface of the bed 11.

A liquid crystal display ("LCD") 15 is disposed at a front surface of the upright arm 12. The LCD 15 is configured to display an image including various items, such as commands, illustrations, settings, and messages. The LCD 15 includes a touch screen 26 on a front surface thereof. The touch screen 26 is configured to detect a position or a portion thereof pressed or touched by a user with his/her finger or a stylus. Based on the position detected by the touch screen 26, an item selected on the image displayed on the LCD 15 is determined by a CPU 81 (refer to FIG. 2) of the sewing machine 1. A user's operation of pressing or touching the touch screen 26 may be hereinafter referred to as a "panel operation". A user is allowed to select a pattern to be sewn from various patterns as well as a command to be executed, with a panel operation. A machine motor 33 (refer to FIG. 2) is disposed inside the upright arm 12.

A cover 16 is disposed at an upper portion of the horizontal arm 13. The cover 16 is configured to pivot between an open position and a closed position. FIG. 1 shows the cover 16 at the open position. A spool storage 18 is located below the cover 16 at the closed position (e.g., in a space defined in the horizontal arm 13). The spool storage 18 is configured to receive a spool 20 having the upper thread wound thereon. Inside the horizontal arm 13, a shaft (refer to FIG. 2) 34 extends in the left-right direction. The shaft 34 is configured to be rotated by the machine motor 33. Various switches, including a start/stop switch 29, are located at a lower left portion of the front surface of the horizontal arm 13. The start/stop switch 29 enables the user to provide an instruction to start or stop an operation of the sewing machine 1, e.g., to start or stop sewing or embroidering.

The head 14 includes a sewing unit 30, a presser bar 8, and an image sensor 57. The sewing unit 30 includes a needle bar 6, and is configured to form stitches on a workpiece C by moving the needle bar 6 up and down. A needle 7 is removably attachable to a lower end of the needle bar 6. The sewing unit 30 further includes the shaft 34 and a needle bar drive mechanism 55. The needle bar drive mechanism 55 is configured to drive the needle bar 6 in the up-down direction by the rotation of the shaft 34. A presser foot 9 is removably attachable to a lower end of the presser bar 8. The image sensor 57 is disposed inside the head 14. The image sensor 57 is located such that the image sensor 57 can capture an image within a predetermined area including an area underneath the needle bar 6. The image sensor 57 is configured to generate image data based on the captured image. The image sensor 57 may be, for example, a known CMOS image sensor. Correspondences between a coordinate system of an image represented by image data generated by the image sensor 57 (hereinafter, referred to as the "image coordinate system") and a coordinate system of the whole space (hereinafter referred to as the "world coordinate system") are established in advance using parameters stored in the flash memory 84. Correspondences between the world coordinate system and an embroidery coordinate system are also established in advance using parameters stored in the flash memory 84. The sewing machine 1 is thus configured to determine coordinates in the embroidery coordinate system based on image data generated by the image sensor 57.

The holder moving unit 40 is detachably attachable to the bed 11 of the sewing machine 1. The holder moving unit 40 includes a holder 43 for holding an embroidery hoop 50, and is configured to move the holder 43 relative to the needle bar 6. The embroidery hoop 50 is detachably attachable to the holder 43. The embroidery hoop 50 may hold a workpiece C. Various types of embroidery hoops including the embroidery hoop 50 may be attached to the holder moving unit 40. The holder moving unit 40 is configured to hold a single embroidery hoop via the holder 43. The embroidery hoop 50 includes hoop members 51 and 52. The hoop members 51 and 52 may sandwich a sheet-like workpiece C (e.g., a work cloth) to hold the workpiece C therebetween. The holder moving unit 40 includes a main body 41 and a carriage 42. The carriage 42 includes the holder 43, a Y-axis movement mechanism 47, and a Y-axis motor 45. The holder 43 is disposed at a right surface of the carriage 42. The holder 43 of the carriage 42 is configured to detachably hold the embroidery hoop 50. The Y-axis movement mechanism 47 is configured to move the holder 43 in the front-rear direction (e.g., a Y-axis direction). The Y-axis motor 45 is configured to drive the Y-axis movement mechanism 47. The main body 41 includes an X-axis movement mechanism 46 and an X-axis motor 44 therein (refer to FIG. 2). The X-axis movement mechanism 46 is configured to move the carriage 42 in the right-left direction (e.g., an X-axis direction). The X-axis motor 44 is configured to drive the X-axis movement mechanism 46. The holder moving unit 40 is configured to move the embroidery hoop 50 attached to the holder 43 of the carriage 42 to stop at a position represented in a unique X-Y coordinate system (e.g., the embroidery coordinate system) in embroidering using the embroidery hoop 50.

Referring to FIG. 2, an electrical configuration of the sewing machine 1 will now be described. The sewing machine 1 includes a CPU 81, a ROM 82, a RAM 83, a flash memory 84, an input/output ("I/O") interface 85, and drive circuits 91, 92, 93, 94, and 95. The CPU 81 is connected to the ROM 82, the RAM 83, the flash memory 84, and the I/O interface 85, via a bus 86.

The CPU 81 executes overall control of the sewing machine 1. The CPU 81 executes various calculations and processing relating to sewing or embroidering, in accordance with programs stored in the ROM 82. The ROM 82 includes a plurality of storage areas including a program storage area. The program storage area stores therein various programs for operating the sewing machine 1. An example of the programs includes a program for executing main processing.

The RAM 83 includes a storage area in which results of calculations performed by the CPU 81 is stored. The flash memory 84 stores therein various parameters to be used for performing the various processing by the sewing machine 1. The flash memory 84 also stores unit pattern data and figure data both for each of a plurality of unit patterns. The unit pattern data may represent a unit pattern that can be embroidered by the sewing machine 1. The figure pattern may represent a shape used as a size reference of a unit pattern. Each unit pattern data may be coordinate data that indicates coordinates in the embroidery coordinate system representing stitch forming positions where one or more stitches included in a unit pattern are formed (e.g., needle drop positions). That is, each unit pattern data includes a group of data representing coordinates of each needle drop position. Each figure data includes dimensions of a rectangle enclosing a unit pattern in the X-axis direction and in the Y-axis direction. The flash memory 84 further stores correspondences between types of embroidery hoops that can be attached to the holder 43 and their embroidery areas. An embroidery area may be defined inside an embroidery hoop attached to the holder 43 of the sewing machine 1, and may be an area in which the sewing machine 1 can form stitches. The I/O interface 85 is connected to the drive circuits 91, 92, 93, 94, and 95, the touch screen 26, the start/stop switch 29, the image sensor 57, and a detector 35. The detector 35 is configured to detect attachment of an embroidery hoop to the holder moving unit 40 and output a detection result based on the type of the attached embroidery hoop. In the illustrative embodiment, the detector 35 detects the type of the attached embroidery hoop based on a combination of on and off of mechanical switches.

The drive circuit 91 is connected to the machine motor 33. Based on a control signal from the CPU 81, the drive circuit 91 drives the machine motor 33. Driving the machine motor 33 causes the needle bar drive mechanism 55 to be driven via the shaft 34, thereby moving the needle bar 6 up and down. The drive circuit 92 is connected to a feed amount adjustment motor 22. Based on a control signal from the CPU 81, the drive circuit 93 drives the LCD 15 to display an image on the LCD 15. The drive circuit 94 is connected to the X-axis motor 44. The drive circuit 95 is connected to the Y-axis motor 45. Based on a control signal from the CPU 81, the drive circuits 94 and 95 drive the X-axis motor 44 and the Y-axis motor 45, respectively. The embroidery hoop attached to the holder moving unit 40 is thus moved in the right-left direction (e.g., the X-axis direction) and in the front-rear direction (e.g., the Y-axis direction) by an amount instructed by the control signal by driving of the X-axis motor 44 and the Y-axis motor 45.

Operation performed by the sewing machine 1 will be briefly described. In embroidering using the embroidery hoop 50, while the holder moving unit 40 is driven to move the embroidery hoop 50 in the X-axis direction and in the Y-axis direction, the needle bar drive mechanism 55 and the shuttle mechanism are also driven. Thus, an embroidery pattern is formed on a workpiece C held by the embroidery hoop 50 using the needle 7 attached to the needle bar 6.

Referring to FIGS. 3A to 8, the main processing executed in the sewing machine 1 will now be described. In the main processing, pattern data representing a rectangular frame embroidery pattern to be used in embroidering is generated. The rectangular frame embroidery pattern includes a combination of a first unit pattern and a second unit pattern. Based on the generated pattern data, the rectangular frame embroidery pattern is formed on a workpiece C held by the embroidery hoop 50. Such a frame embroidery pattern may be formed on a rectangular patchwork quilt along edges thereof. The main processing may start in response to a user's instruction to start editing an embroidery pattern. In response to receiving such an instruction, the controller 2 reads a program for executing the main processing from the program storage area of the ROM 82 and stores the read program in the RAM 83. The controller 2 executes the following steps based on the instructions included in the program read into the RAM 83. The flash memory 84 stores parameters required for executing the main processing. Various data to be obtained during the main processing may be stored in the RAM 83 if necessary. The right-left direction and the top-bottom direction in a drawing sheet of FIGS. 4A to 4E, 5, 7, and 8 correspond to the X-axis direction and the Y-axis direction, respectively.

Figure 3A:
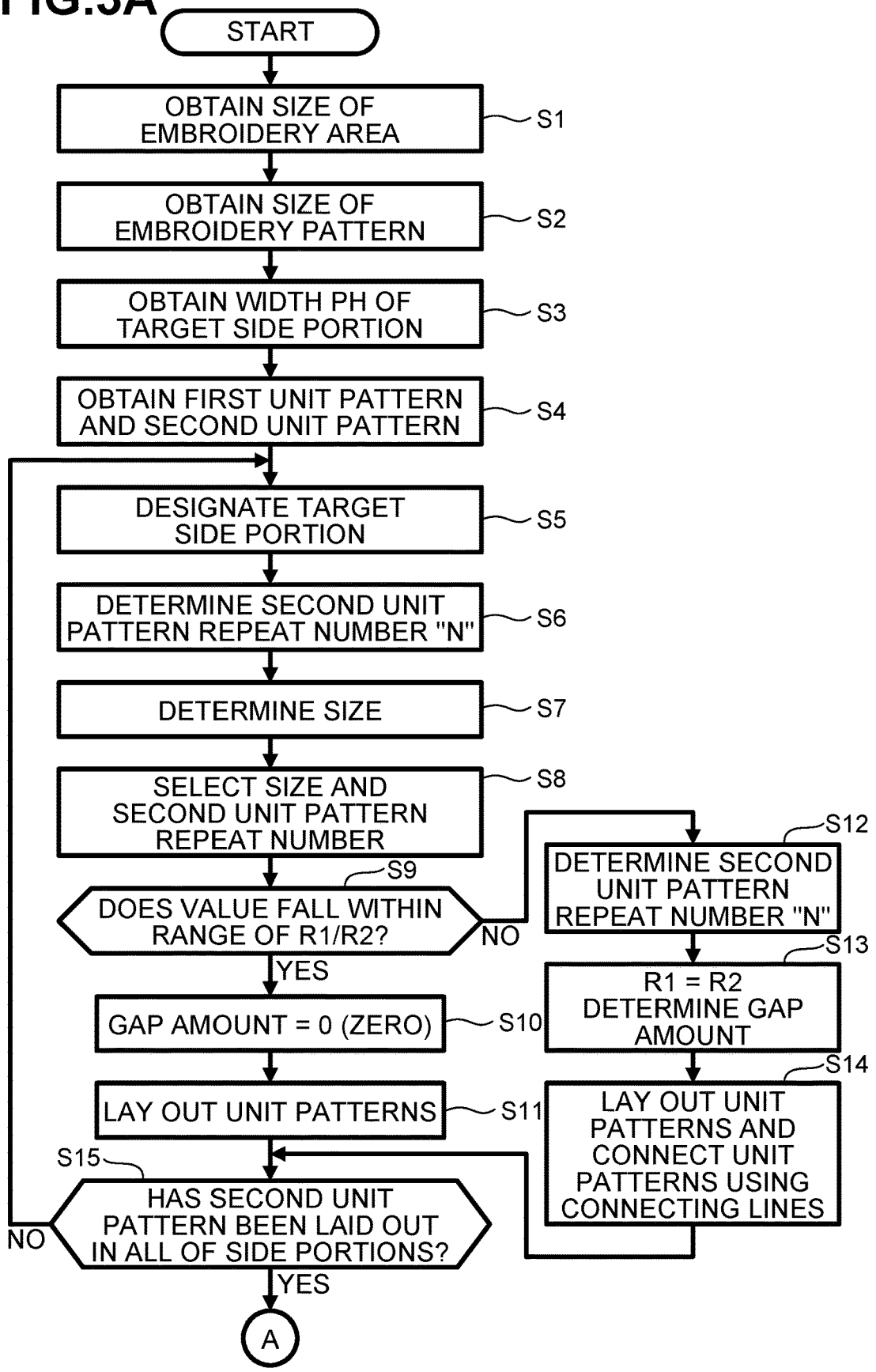
FIGS. 3A and 3B are flowcharts of main processing to be executed by a controller of the sewing machine in the illustrative embodiment according to one or more aspects of the disclosure.
Figure 3B:
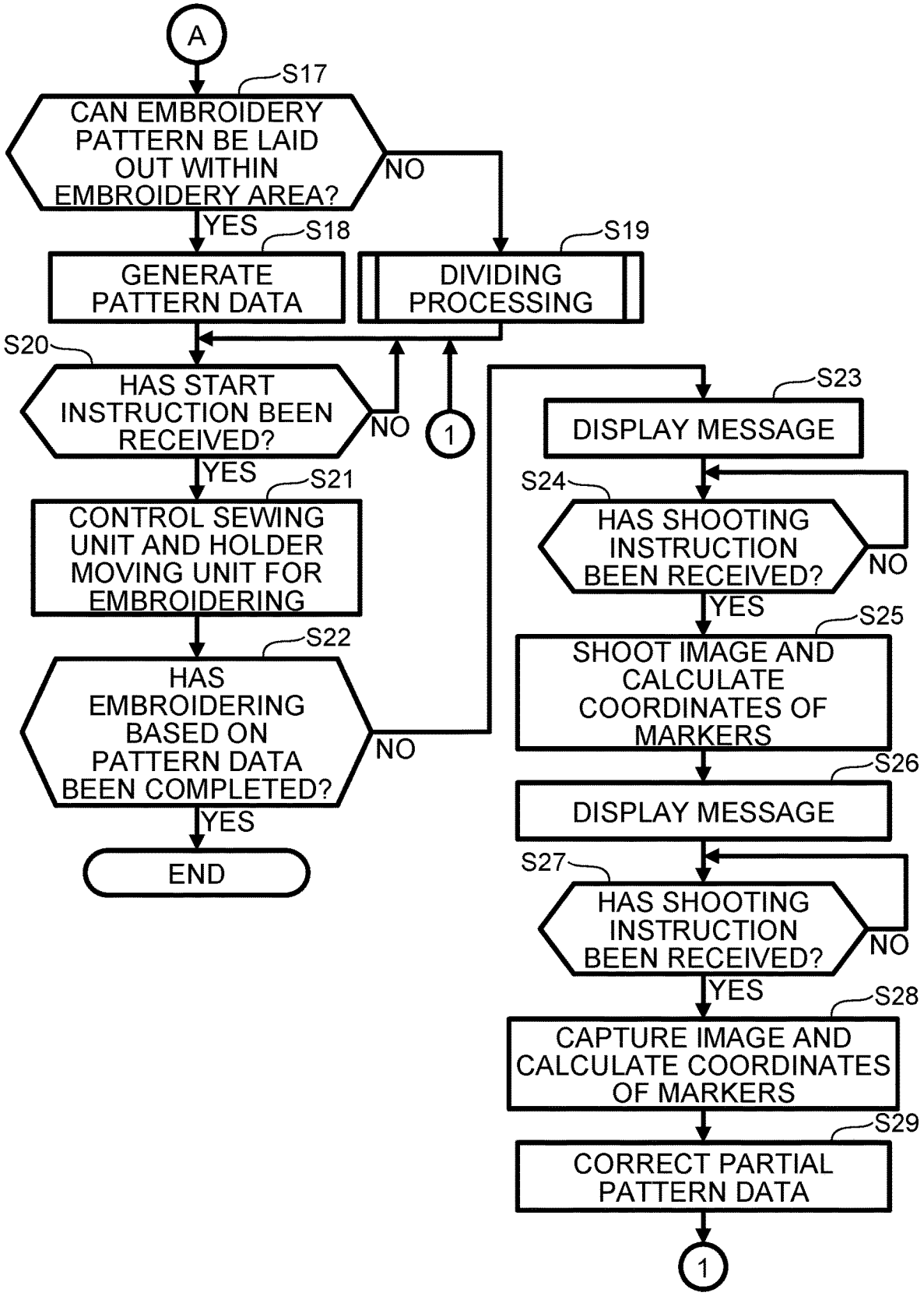
Figure 4A:
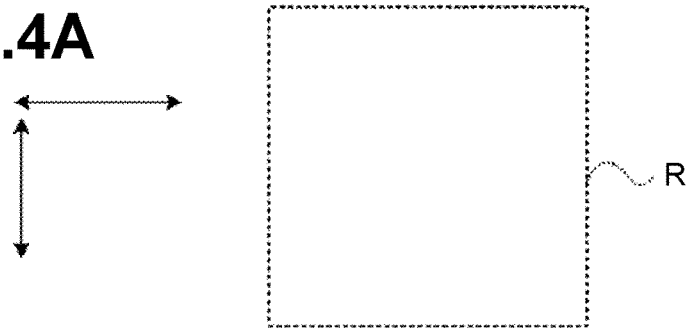
FIGS. 4A to 4E are explanatory diagrams for illustrating how to generate pattern data for an embroidery pattern to be embroidered and pattern data for another embroidery pattern to be embroidered in the illustrative embodiment according to one or more aspects of the disclosure.
Figure 4B:
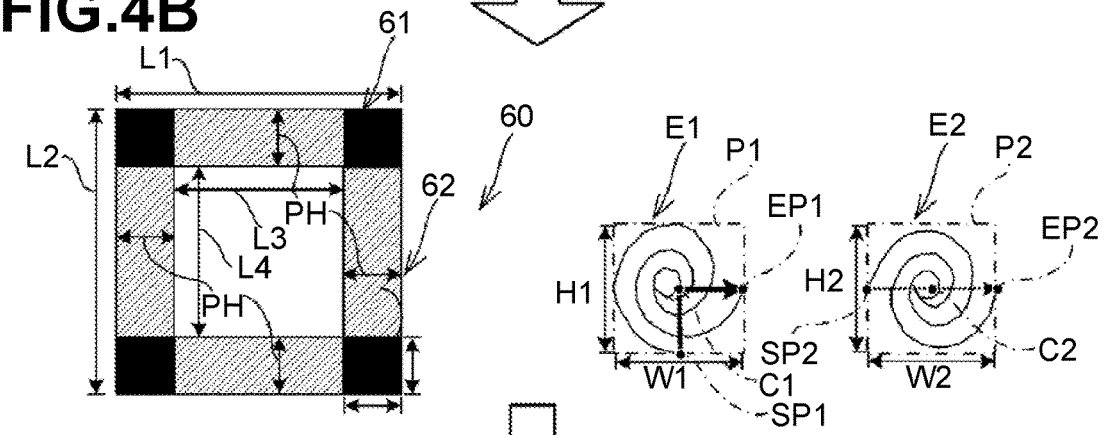

As illustrated in FIGS. 3A and 3B, the controller 2 obtains a size of an embroidery area R defined inside the embroidery hoop 50 attached to the holder 43 (e.g., step S1). More specifically, for example, the controller 2 obtains the size of the embroidery area R based on the type of the attached embroidery hoop 50 and the correspondence between the type and the embroidery area size of the embroidery hoop 50 stored in the flash memory 84. The type of the attached embroidery hoop 50 may be identified based on a detection value outputted by the detector 35. Nevertheless, in other embodiments, the controller 2 may obtain the size of the embroidery area R in another manner. For example, the controller 2 may obtain values entered by a user as the size of the embroidery hoop. In the illustrative embodiment, as illustrated in FIG. 4A, the embroidery area R may have a rectangular shape extending in the X-axis direction and the Y-axis direction of the embroidery coordinate system. The size of the embroidery area R is represented by a dimension in the X-axis direction and a dimension in the Y-axis direction in the embroidery coordinate system. Subsequent to step S1, the controller 2 obtains a size of a rectangular frame embroidery pattern to be embroidered (e.g., step S2). In the illustrative embodiment, positions and sizes of unit patterns to be included in the embroidery pattern are determined such that the unit patterns can be laid out within a hollow rectangular area 60 that extends in the X-axis direction and the Y-axis direction (refer to FIGS. 4B and 4C) of the embroidery coordinate system. The hollow rectangular area 60 has a rectangular frame-like shape. The hollow rectangular area 60 is defined by an outer outline 63 and an inner outline 64. The size of the embroidery pattern is represented by a dimension L1 and a dimension L2. The dimension L1 may be a dimension of the outer outline 63 of the hollow rectangular area 60 in the X-axis direction. The dimension L2 may be a dimension of the outer outline 63 of the hollow rectangular area 60 in the Y-axis direction. The hollow rectangular area 60 includes four corner portions 61 and four side portions 62. In FIG. 4B, the corner portions 61 are filled with black and the side portions 62 are hatched. Each corner portion 61 may be a rectangular area including one of corners of the outer outline 63 of the hollow rectangular area 60 and one of corners of the inner outlines 64 of the hollow rectangular area 60. The corner of the outer outline 63 and the corner of the inner outline 64 are diagonal vertexes of the hollow rectangular area 60. Each side portion 62 may be a rectangular area in which one of four sides extends overlapping a portion of the inner outline 64 of the hollow rectangular area 60. Each side portion 62 is located between two of the corner portions 61.

The LCD 15 is configured to display a screen 70 (refer to FIG. 5) to enable the user to enter the size of the embroidery pattern. The screen 70 includes fields 71, 72, 73, and 74, a virtual key 75, and a virtual keypad 76. The field 71 indicates an entered dimension (e.g., a width) of the embroidery pattern in the X-axis direction. The field 72 indicates an entered dimension (e.g., a length) of the embroidery pattern in the Y-axis direction. The field 73 indicates an entered dimension PH of each side portion 62 in a width direction. Hereinafter, the dimension PH in the width direction may be simply referred to as the "width PH". A direction in which the side of each side portion 62 that overlaps a portion of the inner outline 64 of the hollow rectangular area 60 extends may correspond to a length direction of each side portion 62. A direction perpendicular to the length direction may correspond to the width direction of each side portion 62. In other words, the width PH of each side portion 62 corresponds to an amount of a gap between the inner outline 64 and the outer outline 63. In the illustrative embodiment, the widths PH of all of the side portions 62 are assigned with the same value. In other embodiments, for example, the side portions 62 may have respective different widths. The field 74 indicates a value that is entered by the user and that is to be transferred to a selected one of the fields 71, 72, and 73. The virtual key 75 enables the user to provide an instruction to transfer a value entered in the field 74 by the user, to the selected one of the fields 71, 72, and 73. The virtual keypad 76 enables the user to enter a numeric value in the field 74. The controller 2 obtains the numeric values indicated in the respective fields 71 and 72 as a dimension of the embroidery pattern in the X-axis direction and a dimension of the embroidery pattern in the Y-axis direction, respectively.

The controller 2 obtains the width PH of a target side portion 62 that is an arbitrary one of the side portions 62 (e.g., step S3). In the illustrative embodiment, the widths PH of all of the side portions 62 are assigned with the same value. Thus, the controller 2 obtains, for example, the value indicated in the field 73 as the width PH of the target side portion 62. Subsequent to step S3, the controller 2 obtains a first unit pattern and a second unit pattern to be laid out in the hollow rectangular area 60 (e.g., step S4). The first unit pattern may be laid out in each corner portion 61 of the embroidery pattern. The second unit pattern may be repeatedly laid out in each of the side portions 62 that connect between the corner portions 61. For example, the user performs a panel operation for selecting a unit pattern as a first unit pattern and another unit pattern as a second unit pattern from among various unit patterns stored in the flash memory 84. Based on the user's selection, the controller 2 obtains, for example, a first unit pattern E1 and a second unit pattern E2 (refer to FIG. 4B).

As illustrated in FIG. 4B, each of the first unit pattern E1 and the second unit pattern E2 may be represented by a single continuous line. The first unit pattern E1 has a start point SP1 and an end point EP1. The first unit pattern E1 is enclosed in a rectangle P1. The start point SP1 and the end point EP1 are located on respective two sides of the rectangle P1 perpendicular to each other. The rectangle P1 is represented by the figure data associated with the first unit pattern E1 and is the smallest rectangle that can enclose the first unit pattern E1. A line segment connecting between the start point SP1 of the first unit pattern E1 and a center C1 of the rectangle P1 intersects perpendicular to a line segment connecting between the center C1 of the rectangle P1 and the end point EP1 of the first unit pattern E1. The start point SP1 and the end point EP1 of the first unit pattern E1 correspond to an embroidering start point and an embroidering end point, respectively, of the first unit pattern E1. In the illustrative embodiment, the widths PH of all of the side portions 62 are assigned with the same value. Thus, each corner portion 61 has a square shape. One of four sides of the rectangle P1 on which the start point SP1 of the first unit pattern E1 is located has a dimension W1, and another of the four sides of the rectangle P1 on which the end point EP1 of the first unit pattern E1 is located has a dimension H1. The rectangle P1 for the first unit pattern E1 is square. Thus, the dimension W1 and the dimension H1 are equal to each other. The size of the first unit pattern E1 is represented by the dimensions W1 and H1 of the two perpendicular sides of the rectangle P1.

The second unit pattern E2 has a start point SP2 and an end point EP2. The second unit pattern E2 is enclosed in a rectangle P2. The start point SP2 and the end point EP2 are located on respective two sides of the rectangle P1 opposite to each other. A line segment connecting between the start point SP2 of the second unit pattern E2 and a center C2 of the rectangle P2 lies on the same line as a line segment connecting between the center C2 of the rectangle P2 and the end point EP2 of the second unit pattern E2. The rectangle P2 is represented by the figure data associated with the second unit pattern E2. The rectangle P2 might not be the smallest rectangle that can enclose the second unit pattern E2. The rectangle P2 is used as a size reference if the size of the second unit pattern E2 is changed. The rectangle P2 is also stored in the flash memory 84 in association with the second unit pattern E2. A direction in which a line segment connecting between the start point SP2 and the end point EP2 extends may be referred to as a first direction of the second unit pattern E2. A direction perpendicular to the first direction of the second unit pattern E2 may be referred to as a second direction. The size of the second unit pattern E2 is represented by dimensions of the rectangle P2 in a length direction and a width direction of the rectangle P2. In one example, a dimension W2 of the second unit pattern E2 in the first direction and a dimension H2 of the second unit pattern E2 in the second direction may be equal to each other. In another example, the dimension W2 of the second unit pattern E2 in the first direction and the dimension H2 of the second unit pattern E2 in the second direction may be different from each other. The rectangle P2 is spaced from the second unit pattern E2 in the second direction of the second unit pattern E2 (e.g., the top-bottom direction in FIG. 4B). The size of the first unit pattern E1 may be changed with reference to the rectangle P1. The size of the second unit pattern E2 may be changed with reference to the rectangle P2.

The controller 2 designates arbitrary one of the four side portions 62 as a target side portion (e.g., step S5). In the illustrative embodiment, the widths PH of all of the side portions 62 are assigned with the same value. The controller 2 applies the same settings to each of the side portions 62 whose longer sides extending in the X-axis direction with respect to the number of repeats of a second unit pattern E2 (hereinafter, referred to as the "second unit pattern repeat number") and the size of the second unit pattern E2 repeatedly laid out in a single side portion 62. The controller 2 applies the same settings to each of the side portions 62 whose longer sides extending in the Y-axis direction with respect to the second unit pattern repeat number and the size of the second unit pattern E2 repeatedly laid out in a single side portion 62. The controller 2 designates one of the side portions 62 whose longer sides extending in the X-axis direction and one of the side portions 62 whose longer sides extending in the Y-axis direction as a target side portion in turn, and determines the second unit pattern repeat number in the target side portion 62 and the size of the second unit pattern E2 to be laid out in the target side portion 62. For example, the controller 2 designates one of the side portions 62 whose longer sides extending in the X-axis direction as a target side portion. Hereinafter, for easily understanding, a description will be provided on processing to be executed in a case where one of the side portions 62 whose longer sides extending in the X-axis direction is designated as a target side portion in parallel with processing to be executed in a case where one of the side portions 62 whose longer sides extending in the Y-axis direction is designated as a target side portion. Nevertheless, those processing are executed in respective different timings in actual.

The controller 2 determines, based on the size of the embroidery pattern obtained in step S2, the second unit pattern repeat number N in the target side portion 62 designated in step S5 (e.g., step S6). For example, the controller 2 determines the second unit pattern repeat number N as described below. The controller 2 calculates, using Equation 1, a dimension PW of the second unit pattern E2 (i.e., the rectangle P2) that is enlarged or reduced using a ratio of a dimension H2 to the width PH where the dimension H2 is the dimension of the rectangle P2 in the width direction associated with the second unit pattern E2 obtained in step S4 and the width PH is the dimension of the target side portion 62 in the width direction obtained in step S3. The side of the rectangle P2 in the width direction corresponds to the side of the target side portion 62 in the width direction. The controller 2 tentatively determines the dimension PW at this time. That is, the controller 2 calculates the dimension PW of a similar pattern to the second unit pattern E2 in the first direction of the second unit pattern E2 where the dimension of the rectangle P2 in the width direction associated with the second unit pattern E2 corresponds to the width PH of the target side portion 62 obtained in step S3. The dimension PW refers to the dimension of the similar second unit pattern E2 (e.g., the enlarged or reduced second unit pattern E2) in the first direction of the second unit pattern E2.

$$PW = W2 \times PH / H2 \quad \text{Equation 1}$$

The controller 2 divides the dimension of the target side portion 62 in the length direction (hereinafter, also referred to as the "length of the target side portion 62") by the dimension PW and always rounds up or rounds off the value obtained by the division to the nearest integer value. The controller 2 then determines the integer value as the second unit pattern repeat number in the target side portion 62 (e.g., a first determination method). For example, the controller 2 divides the length of the target side portion 62 by the dimension PW and rounds off the value obtained by the division to the nearest integer value. The controller 2 then determines the integer value as the second unit pattern repeat number in the target side portion 62. For example, the target side portion 62 whose longer sides extending in the X-axis direction and adjacent to two of the corner portions 61 in the X-axis direction has a length L3. The length L3 of the target side portion 62 is calculated using Equation 2. Further, the second unit pattern repeat number NX1 in the target side portion 62 is calculated using Equation 3. For example, the target side portion 62 whose longer sides extending in the Y-axis direction and adjacent to two of the corner portions 61 in the Y-axis direction has a length L4. The length L4 of the target side portion 62 is calculated using Equation 4. Further, the second unit pattern repeat number NY1 in the target side portion 62 is calculated using Equation 5. The Round function rounds off arguments to the number of specified decimal places. In this example, Equations 3 and 5 lead to the conclusion that the second unit pattern repeat numbers NX1 and NY1 are 3, respectively.

$$L3 = L1 - 2PH \quad \text{Equation 2}$$

$$NX1 = \text{Round}(L3/PW) \quad \text{Equation 3}$$

$$L4 = L2 - 2PH \quad \text{Equation 4}$$

$$NY1 = \text{Round}(L4/PW) \quad \text{Equation 5}$$

The controller 2 further calculates the second unit pattern repeat numbers N using another determination method different from the first determination method. Obtaining second unit pattern repeat numbers N using another determination method may enable the controller 2 to select, based on a predetermined condition, appropriate ones from the second unit pattern repeat numbers N obtained by the different determination methods. More specifically, for example, the controller 2 calculates the second unit pattern repeat numbers NX2 and NY2 using Equations 6 and Equation 7, respectively. The controller 2 divides the length of the target side portion 62 by the dimension PW obtained by the calculation using Equation 1 and rounds down the value obtained by the division to the nearest integer value. The controller 2 then determines the integer value as the second unit pattern repeat number in the target side portion 62 (e.g., a second determination method). The Floor function rounds down arguments to a number of specified decimal places. In this example, Equations 6 and 7 lead to the conclusion that the second unit pattern repeat numbers NX2 and NY2 are 2, respectively.

$$NX2=\text{Floor}(L3/PW) \quad \text{Equation 6}$$

$$NY2=\text{Floor}(L4/PW) \quad \text{Equation 7}$$

Subsequent to step S6, the controller 2 then determines, based on the width PH of the target side portion 62 obtained in step S3, the size of the first unit pattern E1 to be laid out in each of the corner portions 61 adjacent to the target side portion 62. More specifically, for example, the controller 2 determines the size of the first unit pattern E1 by enlarging or reducing the size of the first unit pattern E1 so that both of the dimensions W1 and H1 of the perpendicular sides of the rectangle P1 associated with the first unit pattern E1 become equal to the width PH of the target side portion 62. The controller 2 determines, based on the width PH of the target side portion 62 obtained in step S3 and the second unit pattern repeat number determined in step S6, the size of the second unit pattern E2 to be repeatedly laid out in the target side portion 62 (e.g., step S7). The controller 2 assigns the dimension of the second unit pattern E2 in the second direction a value equal to the width PH of the target side portion 62 obtained in step S3. The controller 2 divides the length of the target side portion 62 by the second unit pattern repeat number N determined in step S6, and assigns the dimension PW of the second unit pattern E2 (i.e., the rectangle P2) to be repeatedly laid out in the target side portion 62 the value obtained by the division. In the illustrative embodiment, a plurality of second unit pattern repeat numbers N have been obtained using the different determination methods in step S6. Thus, the controller 2 determines the dimension PW with respect to each of the second unit pattern repeat numbers N.

Subsequent to step S7, the controller 2 selects an appropriate combination from the combinations of the second unit pattern repeat numbers determined in step S6 and the sizes of the second unit pattern E2 determined in step S7 (e.g., step S8). The appropriate combination may be a combination that a value Z that is obtained by dividing a first ratio R1 by a second ratio R2 is closer to 1 (one) than the other. The first ratio R1 may be a ratio of the dimension PW determined in step S7 to the dimension W2 of the second unit pattern E2 in the first direction. The second ratio R2 may be a ratio of the dimension of the second unit pattern E2 in the second direction determined in step S7 (i.e., the width PH) to the dimension H2 of the second unit pattern E2 in the second direction. More specifically, for example, in a case where one of the side portions 62 whose longer sides extending in the X-axis direction is designated as a target side portion, the controller 2 selects the combination corresponding to the second unit pattern repeat number NX1. In a case where one of the side portions 62 whose longer sides extending in the Y-axis direction is designated as a target side portion, the controller 2 selects the combination corresponding to the second unit pattern repeat number NY1. Subsequent to step S8, the controller 2 determines whether the value Z of the combination selected in step S8 falls within a predetermined range (e.g., step S9). Upper and lower limits of the predetermined range used in step S9 may be determined as appropriate. For example, the lower limit may be greater than 0.8 and the upper limit may be smaller than 1.3.

Figure 4C:
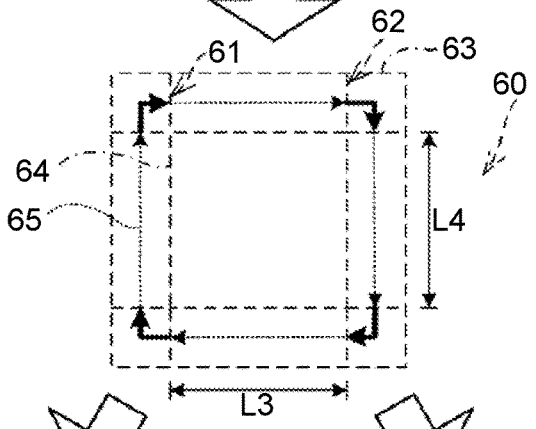
Figure 4D:
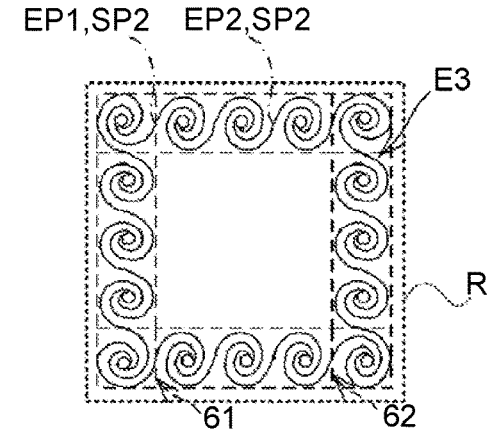

In the specific example, the value Z falls within the predetermined range (e.g., YES in step S9). In such a case, the controller 2 assigns 0 (zero) to a gap amount (e.g., step S10). The gap amount refers to an amount of a gap between ends of adjacent first and second unit patterns E1 and E2 laid out in the hollow rectangular area 60, and an amount of a gap between ends of adjacent second unit patterns E2 laid out in the hollow rectangular area 60. In the illustrative embodiment, the controller 2 assigns the same value to the gap amounts for all the gaps between adjacent unit patterns laid out in the target side portion 62. The controller 2 lays out the first unit pattern E1 obtained in step S4 in each corner portion 61, and also lays out repeatedly the second unit pattern E2 obtained in step S4 in the target side portion 62 as many as the second unit pattern repeat number that has been determined in step S6 and selected in step S8 (e.g., step S11). More specifically, for example, in the illustrative embodiment, the controller 2 lays out the first unit pattern E1 that has been obtained in step S4 and has the size determined in step S7, in each of the corner portions 61 adjacent to the target side portion 62 designated in step S5. The controller 2 then lays out the second unit pattern E2 that has been obtained in step S4 and has the size determined in step S7, in the target side portion 62 as many as the second unit pattern repeat number that has been determined in step S6 and selected in step S8. The controller 2 lays out the unit patterns with ends of adjacent unit patterns overlapping each other. More specifically, for example, the controller 2 lays out the first and second unit patterns E1 and E2 such that ends of adjacent first and second unit patterns E1 and E2 overlap each other and ends of adjacent second unit patterns E2 overlap each other. An arrow 65 is defined in each unit pattern such that the arrow 65 points toward the end point from the start point of the unit pattern. As illustrated in FIG. 4C, the controller 2 determines a layout of the unit patterns such that the arrows 65 of the unit patterns circulate clockwise. As illustrated in FIG. 4D, the controller 2 lays out the first unit pattern E1 and the second unit pattern E2 in the hollow rectangular area 60 with ends of adjacent unit patterns overlapping each other by, if necessary, rotating the unit patterns, such that the arrow 65 of each unit pattern points to the specified direction. The direction toward which the arrow 65 of each unit pattern in one of the opposite side portions 62 points is 180 degrees opposite to the direction toward which the arrow 65 of each unit pattern in the other of the opposite side portions 62.

If the controller 2 determines that the value Z does not fall within the predetermined range (e.g., NO in step S9), the controller 2 determines the second unit pattern repeat number NX2 or NY2 that has been determined in step S6, as the second unit pattern repeat number in the target side portion 62 (e.g., step S12). The values assigned to the second unit pattern repeat number NX2 and NY2 are obtained by rounding down to the nearest integers. The controller 2 assigns the value obtained by the calculation using Equation 1 to the dimension PW and further determines a gap amount DX or DY by calculation using Equation 8 or 9. The gap amount DX may be an amount of a gap between adjacent unit patterns laid out in the target side portion 62 whose longer sides extending in the X-axis direction. The gap amount DY may be an amount of a gap between adjacent unit patterns laid out in the target side portion 62 whose longer sides extending in the Y-axis direction. The controller 2 assigns the second ratio R2 to the first ratio R1 (e.g., step S13). That is, the controller 2 finalizes the size of the second unit pattern E2 for the size tentatively determined in step S6.

$$DX=(L3-PW\times NX)/(NX+1) \quad \text{Equation 8}$$

$$DY=(L4-PW\times NY)/(NY+1) \quad \text{Equation 9}$$

Figure 4E:
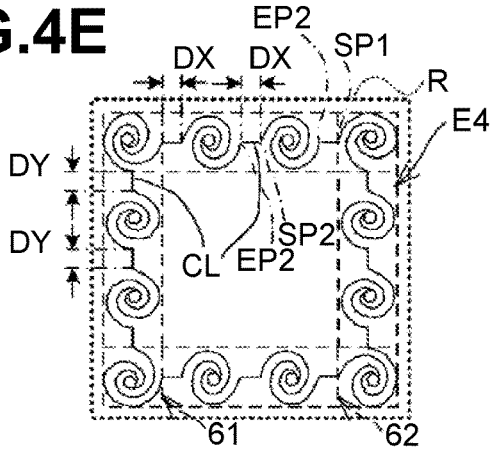
Figure 5:
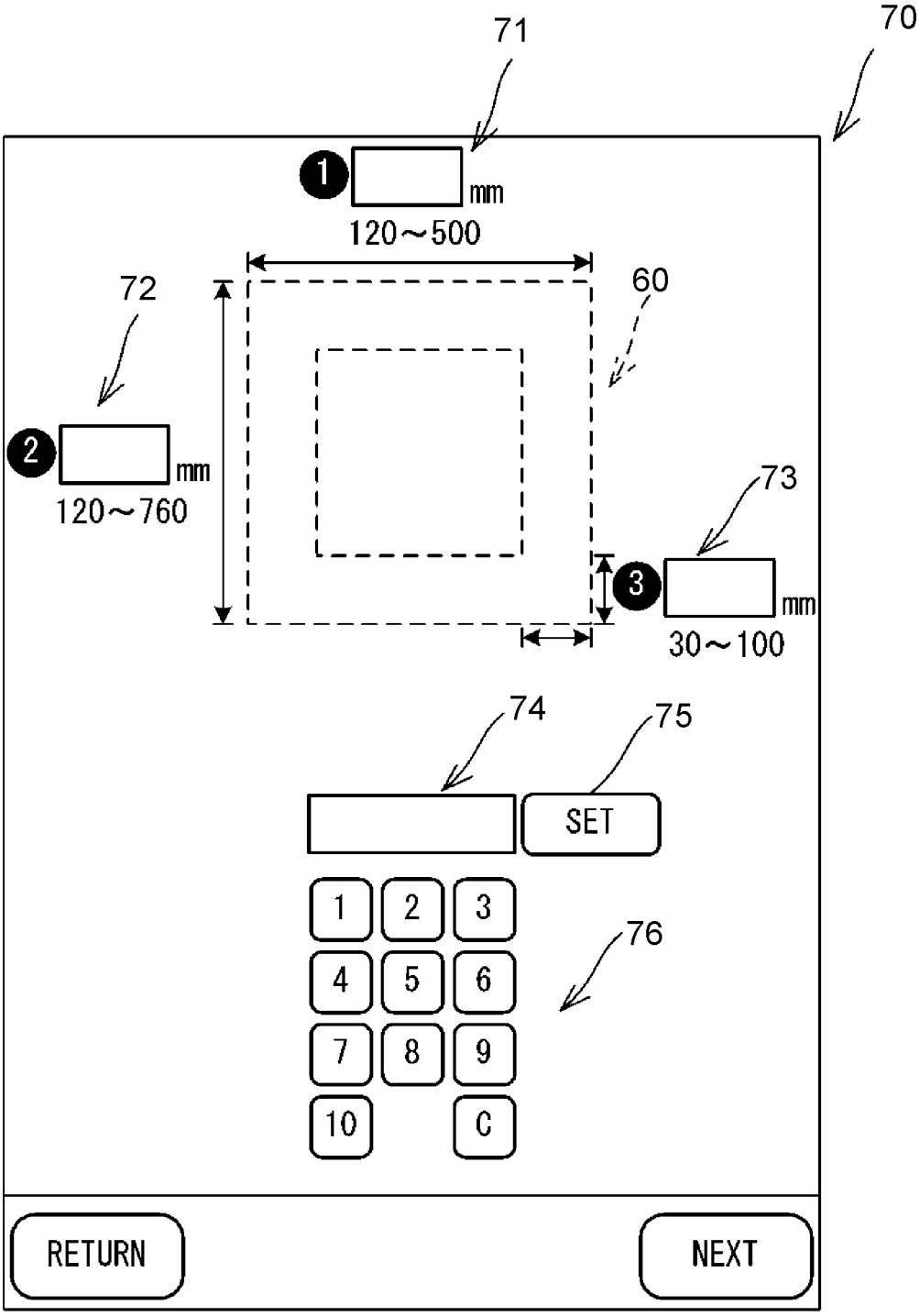
FIG. 5 illustrates a screen for entry of a size of an embroidery pattern in the illustrative embodiment according to one or more aspects of the disclosure.

The controller 2 lays out the first unit pattern E1 obtained in step S4 in each corner portion 61, and also lays out repeatedly the second unit pattern E2 obtained in step S4 in the target side portion 62 as many as the second unit pattern repeat number that has been determined in step S6 and selected in step S8 (e.g., step S14). In the illustrative embodiment, the controller 2 lays out the first unit pattern E1 that has been obtained in step S4 and has the size determined in step S7, in each of the corner portions 61 adjacent to the target side portion 62. The controller 2 adjusts gaps between adjacent unit patterns in accordance with the gap amount DX or DY determined in step S13 and repeatedly lays out, in the target side portion 62, the second unit pattern E2 that has been obtained in step S4 and has the size determined in step S13 as many as the second unit pattern repeat number NX2 or NY2 determined in step S12. The controller 2 then connects, using connecting lines, between adjacent first and second unit patterns E1 and E2 and between adjacent second unit patterns E2 (e.g., step S14). The connecting line may be a line segment connecting between the ends of the adjacent unit patterns. The connecting line may be, for example, a straight line or a curved line. In another example, the connecting line may be a zigzag line formed by a utility stitch or a heart-shaped pattern formed by a decorative stitch. In the illustrative embodiment, as illustrated in FIG. 4E, a connecting line CL is a line segment extending in the X-axis direction or a line segment extending in the Y-axis direction in the embroidery coordinate system. Similar to step S11, in step S14, as illustrated in FIG. 4C, the controller 2 determines a layout of the unit patterns such that the arrows 65 of the unit patterns circulate clockwise. As illustrated in FIG. 4E, the controller 2 lays out the unit patterns with the ends of adjacent unit patterns being connected using the respective connecting lines CL by, if necessary, rotating the unit patterns, such that the arrow 65 of each unit pattern points to the specified direction.

Subsequent to step S11 or S14, the controller 2 determines whether the second unit pattern E2 has been laid out in all of the side portions 62 (e.g., step S15). If the controller 2 determines that the second unit pattern E2 has not been laid out in at least one of the side portions 62 (e.g., NO in step S15), the routine returns to step S5. In step S5, the controller 2 designates, as a target side portion, another side portion 62 in which the second unit pattern E2 has not been laid out, and executes the subsequent steps again. FIG. 4D illustrates an embroidery pattern E3 designed in step S11. FIG. 4E illustrates an embroidery pattern E4 designed in step S14. Each of the embroidery patterns E3 and E4 can be laid out within the hollow rectangular area 60. Each of the embroidery patterns E3 and E4 is represented by a single continuous line and includes the first unit pattern E1 and the second unit pattern E2.

Subsequent to step S11 or S14, the controller 2 determines, in step S15, that the second unit pattern E2 has been laid out in all of the side portions 62 (e.g., YES in step S15), the controller 2 determines whether the embroidery pattern obtained in step S2 can be laid out within the embroidery area R obtained in step S1 (e.g., step S17). If the controller 2 determines that the embroidery pattern obtained in the step S2 can be laid out within the embroidery area R (e.g., YES in step S17), the routine proceeds to step S18. In step S18, the controller 2 generates pattern data for the embroidery pattern to be embroidered designed in step S11 or S14. The pattern data includes coordinate data indicating positions of stitches representing an embroidery pattern. Subsequent to step S18 or S19, the controller 2 determines whether a start instruction to start embroidering in accordance with the pattern data generated in step S18 has been received (e.g., step S20). In response to, for example, detecting the pressing of the start/stop switch 29, the controller 2 determines that the start instruction has been received. If the controller 2 determines that the start instruction has not been received (e.g., NO in step S20), the controller 2 waits for receiving the start instruction. If the controller 2 determines that the start instruction has been received (e.g., YES in step S20), the controller 2 controls the sewing unit 30 and the holder moving unit 40 based on the embroidery pattern data generated in step S18, thereby forming the embroidery pattern on the workpiece C held by the embroidery hoop 50 (e.g., step S21). Subsequent to step S21, the controller 2 determines whether the embroidering based on the pattern data has been completed (e.g., step S22). If the controller 2 determines that the embroidering based on the pattern data has been completed (e.g., YES in step S22), the controller 2 ends the main processing.

Figure 7A:
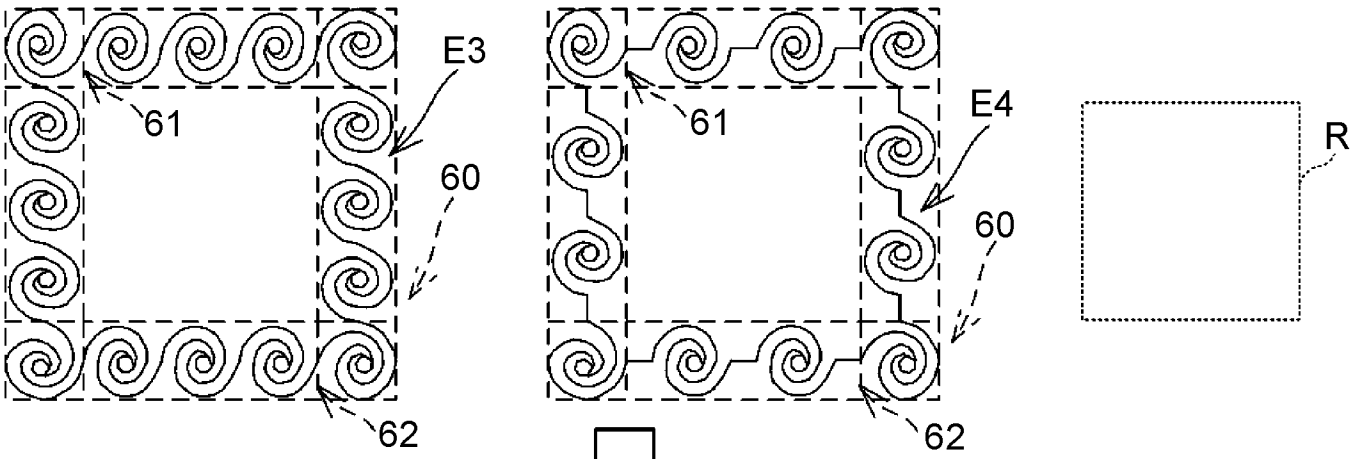
FIGS. 7A to 7E are explanatory diagrams for explaining dividing processing executed on the embroidery patterns of FIG. 7A and illustrating how to generate each pattern data for a corresponding one of embroidery patterns to be embroidered of FIGS. 7D to 7G in the illustrative embodiment according to one or more aspects of the disclosure.

If, in step S17, the controller 2 determines that the embroidery pattern obtained in step S2 cannot be laid out within the embroidery area R obtained in step S1 (e.g., step S17), the controller 2 executes dividing processing (e.g., step S19). In the dividing processing, the embroidery pattern is divided into a plurality of partial patterns each having a size that can be laid out within an embroidery area R. Further, a plurality of pieces of partial pattern data for respective partial patterns of the embroidery pattern to be embroidered are generated. Each partial pattern represented by corresponding partial pattern data is formed on the workpiece C by changing relative positions between the workpiece C and the embroidery hoop 50. It is assumed that, as illustrated in FIG. 7A, the embroidery area R is obtained in step S1 and the embroidery patterns E3 and E4 are designed in combination of the first unit pattern E1 and the second unit pattern E2 in step S11. For easy understanding, the dividing processing for the embroidery pattern E3 and the dividing processing for the embroidery pattern E4 will be described in parallel although being executed at respective different timing in actual.

Figure 6:
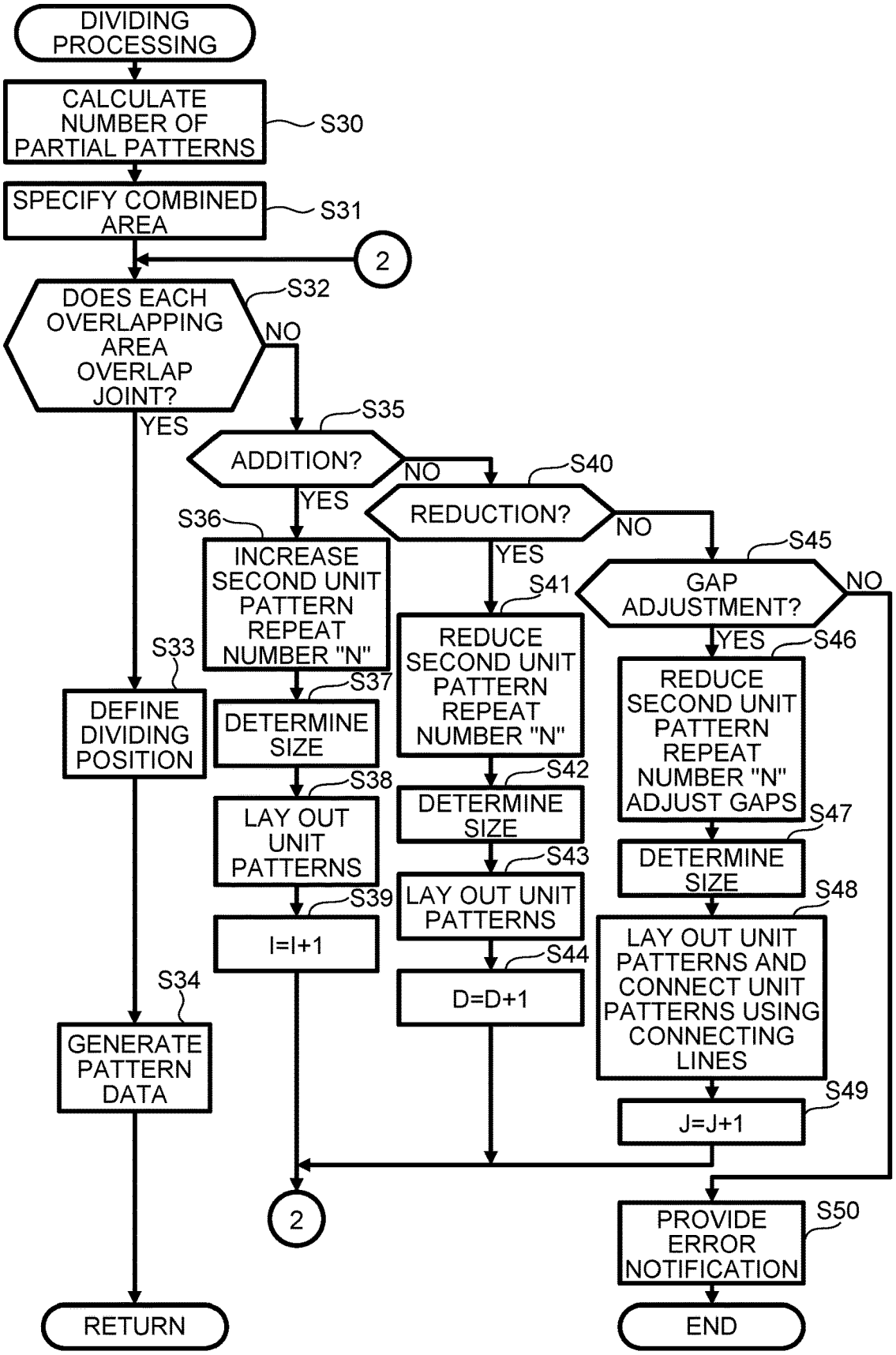
FIG. 6 is a flowchart of dividing processing to be executed in the main processing in the illustrative embodiment according to one or more aspects of the disclosure.
Figure 7B:
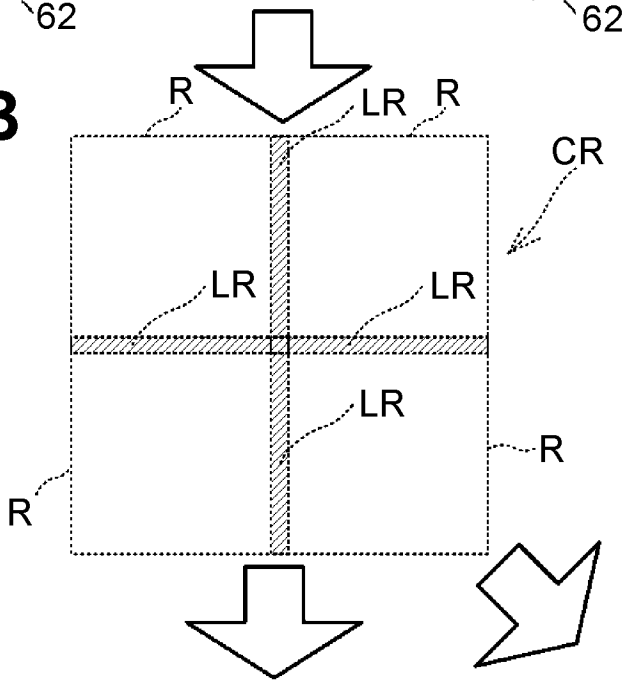

In the dividing processing, as illustrated in FIG. 6, the controller 2 calculates the number of partial patterns into which the embroidery pattern E3 or E4 is divided (hereinafter, simply referred to as the "number of partial patterns") (e.g., step S30). Each partial pattern has a size smaller than the embroidery area R. The controller 2 calculates the number of partial patterns. More specifically, for example, the controller 2 divides the dimension of the embroidery pattern E3 or E4 in the X-axis direction by the dimension of the embroidery area R in the X-axis direction and rounds up the obtained value to the nearest integer to obtain a value K1. The controller 2 divides the dimension of the embroidery pattern E3 or E4 in the Y-axis direction by the dimension of the embroidery area R in the Y-axis direction and rounds up the obtained value to the nearest integer to obtain a value K2. The controller 2 then multiplies the value K1 by the value K2 to obtain the number of sections to be divided. The controller 2 specifies a combined area CR based on the number of partial patterns calculated in step S30 (e.g., step S31). The combined area CR consists of a plurality of embroidery areas R obtained in step S1 with adjacent embroidery areas R partially overlapping each other. The combined area CR is larger in size than each of the embroidery patterns E3 and E4. In the illustrative embodiment, for example, as illustrated in FIG. 7B, in step S31, the controller 2 specifies a combined area CR consisting of four embroidery areas R arranged in a two-by-two matrix. The combined area CR includes overlapping areas LR where adjacent embroidery areas R partially overlap each other. In FIGS. 7B to 7G, the overlapping areas LR are hatched. In the combined area CR, an overlapping area LR is defined in each pair (e.g., four pairs) of adjacent two of the embroidery areas R. Thus, the combined area CR has four overlapping areas LR. In one example, an overlapping amount of target adjacent embroidery areas R may be determined in advance. In another example, the overlapping amount may be specified by the user.

Figures 7C, 7D, 7E, 7F, 7G:
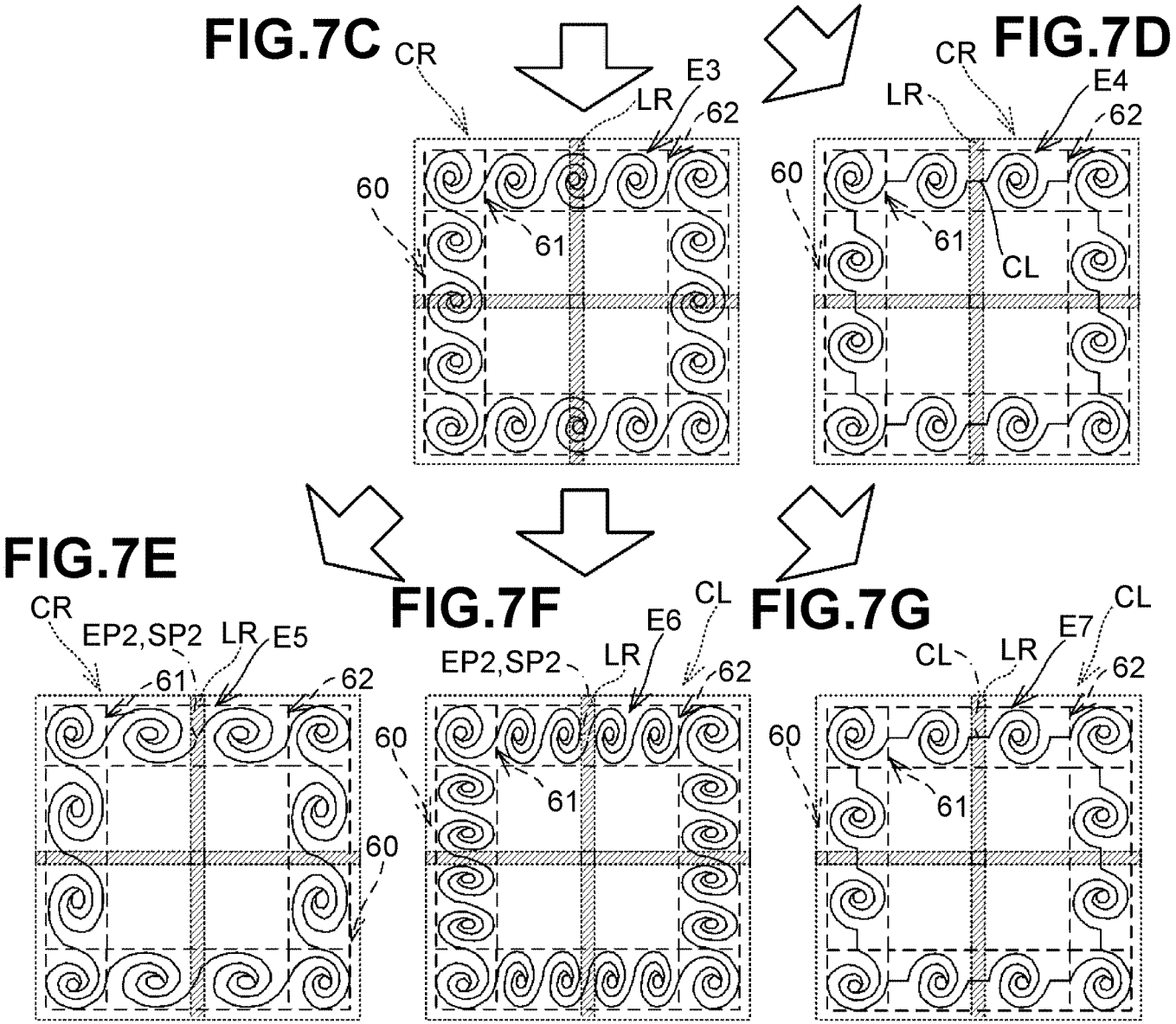
Figure 8:
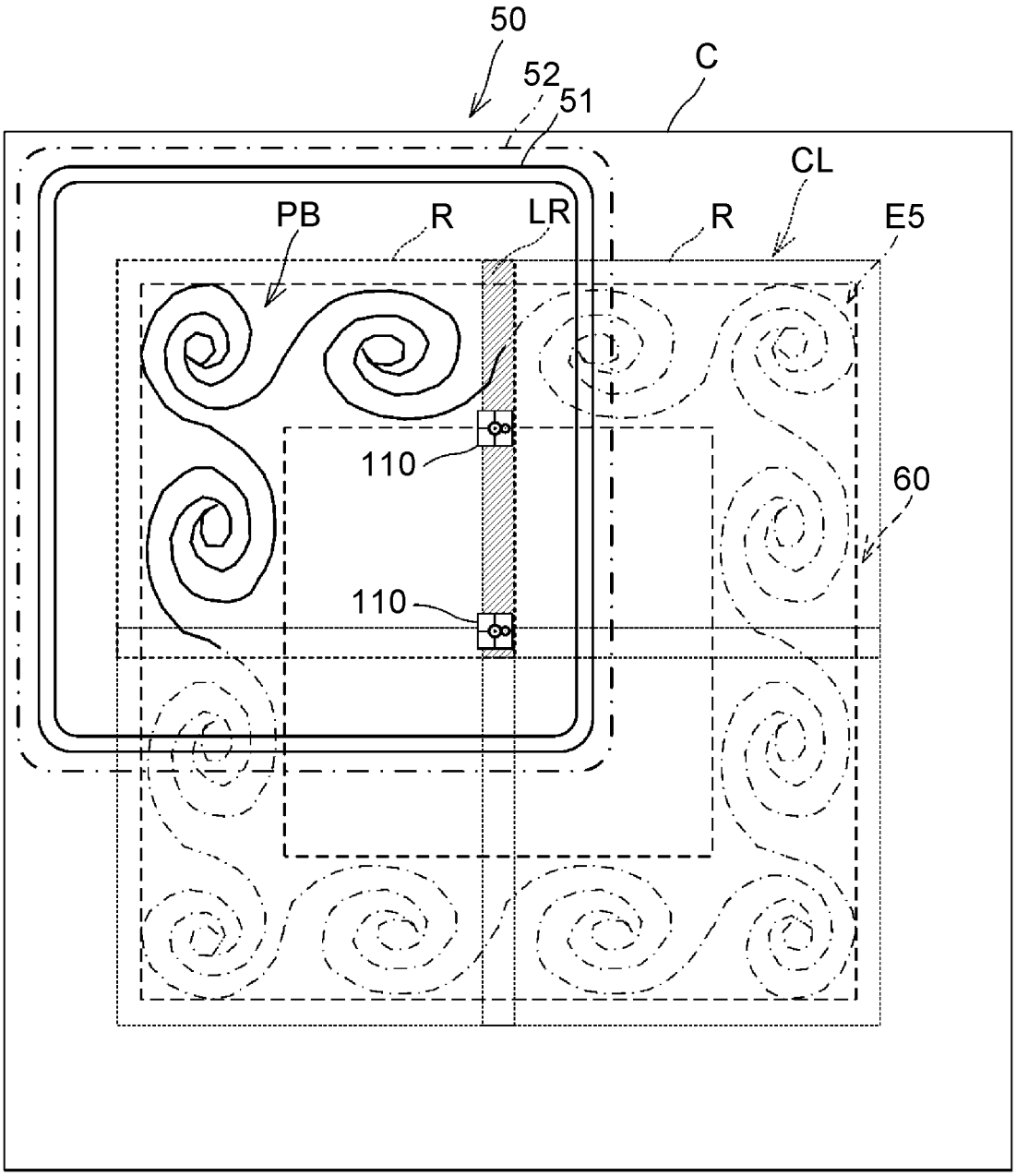
FIG. 8 is an explanatory diagram for positioning a workpiece with reference to markers in a case where the sewing machine embroiders an embroidery pattern of FIG. 7E in the illustrative embodiment according to one or more aspects of the disclosure.

Subsequent to step S31, the controller 2 determines whether each of the overlapping areas LR overlaps one of joints of the embroidery pattern E3 or E4 in a case where the embroidery pattern E3 or E4 is laid out in the combined area CR specified in step S31 (e.g., step S32). A joint may be a point where adjacent unit patterns are connected to each other. In the illustrative embodiment, the joint may include the ends of the first unit pattern E1, the ends of the second unit pattern E2, and connecting lines. As illustrated in FIG. 7D, in a case where the embroidery pattern E4 is laid out in the combined area CR, each of the overlapping areas LR overlaps one of the joints (e.g., one of the connecting lines CL) of the embroidery pattern E4 (e.g., YES in step S32). In such a case, the controller 2 defines a dividing position in each overlapping area LR (e.g., step S33). The controller 2 then generates, with respect to each of the embroidery areas R consisting of the combined area CR, partial pattern data for a partial pattern of the embroidery pattern to be embroidered. That is, the controller 2 generates pattern data for the embroidery pattern to be embroidered including the plurality of pieces of the partial pattern data (e.g., step S34). Each partial pattern of the embroidery pattern can be laid out within a corresponding embroidery area R. For example, for the embroidery pattern E4 (refer to FIG. 7D), the controller 2 generates four pieces of partial pattern data and determines an embroidery sequence of the partial patterns of the embroidery pattern E4 (hereinafter, referred to as the "embroidery sequence"). For example, the embroidery pattern E4 may be formed in the order of an upper-left partial pattern, an upper-right partial pattern, a lower-right partial pattern, and a lower-left partial pattern. That is, the controller 2 determines the embroidering order such that the partial patterns of the embroidery pattern E4 are embroidered clockwise from the upper-left partial pattern in accordance with the layout of the embroidery areas R. The embroidery sequence may be determined appropriately in consideration given to positioning of the partial patterns of the embroidery pattern relative to each other. In response to completing the generation of the pattern data, the controller 2 ends the dividing processing. Thus, the routine returns to the main processing (refer to FIGS. 3A and 3B).

As illustrated in FIG. 7C, in a case where the embroidery pattern E3 is laid out in the combined area CR, none of the overlapping areas LR overlaps a joint (e.g., NO in step S32). In such a case, the controller 2 changes at least the size and the second unit pattern repeat number using one of first, second, and third adjustment methods such that each of the overlapping areas LR overlaps one of the joints of the embroidery pattern. In the first adjustment method, the controller 2 increases the second unit pattern repeat number in a side portion including the overlapping area LR that does not overlap any joint (hereinafter, referred to as the "adjustment-target side portion 62") and adjusts the size of the second unit pattern E2 to be laid out in the adjustment-target side portion 62 to a suitable size. In the second adjustment method, the controller 2 reduces the second unit pattern repeat number in the adjustment-target side portion 62 and adjusts the size of the second unit pattern E2 to be laid out in the adjustment-target side portion 62 to a suitable size. In the third adjustment method, in addition to changing the second unit pattern repeat number and the size of the second unit pattern E2 to be laid out in the adjustment-target side portion 62, the controller 2 adjusts the amount of gap between adjacent unit patterns and connects between the adjacent unit patterns using connecting lines. In one example, the adjustment method to be applied may be determined by the user. In another example, the adjustment method to be applied may be determined in advance.

If the controller 2 determines that the first adjustment method (e.g., addition) is applicable (e.g., YES in step S35), the controller 2 adds a predetermined value greater than 1 (one) to the current second unit pattern repeat number for the adjustment-target side portion 62 (e.g., step S36). The controller 2 divides the length of the adjustment-target side portion 62 by the second unit pattern repeat number reassigned in step S36 and assigns the obtained value to the dimension PW (e.g., step S37). Similar to step S11, the controller 2 lays out the first unit pattern E1 and the second unit pattern E2 within the hollow rectangular area 60 based on the second unit pattern repeat number reassigned in step S36 and the size of the second unit pattern E2 determined in step S37 (e.g., step S38). In response to adding 1 (one) to the second unit pattern repeat number for each side portion 62 of the embroidery pattern E3 (e.g., step S36), the controller 2 creates an embroidery pattern E6 (refer to FIG. 7F) by laying out the first unit pattern E1 and the second unit pattern E2. Subsequent to step S38, the controller 2 increments a variable I by one (e.g., step S39). The variable I represents the count of additions to the second unit pattern repeat number in step S36. An initial value of the variable I is 0 (zero). If the controller 2 determines that the variable I is greater than a threshold, the controller 2 determines that the first adjustment method is not applicable (e.g., NO in step S35). Subsequent to step S39, the routine returns to step S32. As illustrated in FIG. 7F, in a case where an embroidery pattern E6 is laid out in the combined area CR, each of the overlapping areas LR overlaps one of the joints (e.g., YES in step S32). Thus, the controller 2 defines a dividing position in each overlapping area LR based on the unit pattern layout determined in step S38 (e.g., step S33) and generates pattern data including a plurality of pieces of partial pattern data (e.g., step S34). In response to completing the generation of the pattern data, the controller 2 ends the dividing processing. Thus, the routine returns to the main processing (refer to FIGS. 3A and 3B).

If the controller 2 determines that the second adjustment method (e.g., reduction) is applicable (e.g., NO in step S35 and then YES in step S40), the controller 2 reduces a predetermined value greater than 1 (one) from the current second unit pattern repeat number for the adjustment-target side portion 62 (e.g., step S41). The controller 2 divides the length of the adjustment-target side portion 62 by the second unit pattern repeat number reassigned in step S41 and assigns the obtained value to the dimension PW (e.g., step S42). Similar to step S11, the controller 2 lays out the first unit pattern E1 and the second unit pattern E2 within the hollow rectangular area 60 based on the second unit pattern repeat number reassigned in step S41 and the size of the second unit pattern E2 determined in step S42 (e.g., step S43). In response to reducing 1 (one) from the second unit pattern repeat number for each side portion 62 of the embroidery pattern E3 (e.g., step S41), the controller 2 creates an embroidery pattern E5 (refer to FIG. 7E) by laying out the first unit pattern E1 and the second unit pattern E2. Subsequent to step S43, the controller 2 increments a variable D by one (e.g., step S44). The variable D represents the count of reductions from the second unit pattern repeat number in step S41. An initial value of the variable D is 0 (zero). If the controller 2 determines that the variable D is greater than a threshold, the controller 2 determines that the second adjustment method is not applicable (e.g., NO in step S40). Subsequent to step S44, the routine returns to step S32. As illustrated in FIG. 7E, in a case where the embroidery pattern E5 is laid out in the combined area CR, each of the overlapping areas LR overlaps one of joints of the embroidery pattern E5 (e.g., YES in step S32). Thus, the controller 2 defines a dividing position in each overlapping area LR based on the unit pattern layout determined in step S43 (e.g., step S33) and generates pattern data including a plurality of pieces of partial pattern data (e.g., step S34). In response to completing the generation of the pattern data, the controller 2 ends the dividing processing. Thus, the routine returns to the main processing (refer to FIGS. 3A and 3B).

If the controller 2 determines that the third adjustment method (e.g., gap adjustment) is applicable (e.g., NO in step S35, NO in step S40, and then YES in step S54), the controller 2 reduces a predetermined value greater than 1 (one) from the current second unit pattern repeat number for the adjustment-target side portion 62. Further, the controller 2 reassigns the gap amount similar to step S13 (e.g., step S46). Similar to step S13, the controller 2 assigns the dimension PW a value equal to the width PH of the target side portion 62 obtained in step S3. Similar to step S14, the controller 2 lays out the first unit pattern E1 and the second unit pattern E2 within the hollow rectangular area 60 based on the second unit pattern repeat number reassigned in step S46, the size of the second unit pattern E2 determined in step S47, and the gap amount assigned in step S46. Further, the controller 2 connects between the adjacent unit patterns using connecting lines. (e.g., step S38). In response to reducing 1 (one) from the second unit pattern repeat number for each side portion 62 of the embroidery pattern E3 (e.g., step S46), the controller 2 creates an embroidery pattern E7 (refer to FIG. 7G) by laying out the first unit pattern E1 and the second unit pattern E2. Subsequent to step S48, the controller 2 increments a variable J by one (e.g., step S49). The variable J represents the count of reductions from the second unit pattern repeat number in step S46. An initial value of the variable J is 0 (zero). If the controller 2 determines that the variable J is greater than a threshold, the controller 2 determines that the second adjustment method is not applicable (e.g., NO in step S45). Subsequent to step S49, the routine returns to step S32. As illustrated in FIG. 7G, in a case where the embroidery pattern E7 is laid out in the combined area CR, each of the overlapping areas LR overlaps one of joints of the embroidery pattern E7 (e.g., YES in step S32). Thus, the controller 2 defines a dividing position in each overlapping area LR based on the unit pattern layout determined in step S48 (e.g., step S33) and generates pattern data including a plurality of pieces of partial pattern data (e.g., step S34). In response to completing the generation of the pattern data, the controller 2 ends the dividing processing. Thus, the routine returns to the main processing (refer to FIGS. 3A and 3B).

If the controller 2 determines that all of the variables I, D, and J exceed the respective thresholds (e.g., NO in step S35, NO in step S40, and then NO in step S45), the controller 2 causes the LCD 15 to provide error notification (e.g., step S50). For example, the controller 2 causes the LCD 15 to display a message indicating that "Failed to generate pattern data." The controller 2 thus ends the dividing processing and the main processing.

In step 21 subsequent to step S19 (e.g., the dividing processing), the controller 20 executes processing for reading partial pattern data in the embroidery sequence and performing embroidery based on the read partial pattern data. It is assumed that the embroidery pattern E5 is formed on a workpiece in embroidering. If, in step S20, the controller 2 determines that the start instruction to start embroidering based on the partial pattern data for the first partial pattern in the embroidery sequence has been received (e.g., YES in step S20), the controller 2 reads the partial pattern data for the first partial pattern from among the plurality of pieces of partial pattern data of the embroidery pattern generated in step S34 and controls the sewing unit 30 and the holder moving unit 40 based on the read partial pattern data (e.g., step S21), thereby forming the first partial pattern on the workpiece. In response to completion of the embroidering based on the partial pattern data for the first partial pattern (e.g., a partial pattern PB indicated by a solid line in FIG. 8), the controller 2 determines that the embroidering based on the pattern data has not been completed, that is, the partial pattern data for the last partial pattern of the embroidery pattern has not been used in the embroidering (e.g., NO in step S22). The controller 2 thus controls the drive circuit 93 to display a message on the LCD 15 (e.g., step S23). The message may be, for example, that "Place markers on the workpiece and then provide a shooting instruction." In response to such a message, the user places two markers 110 on or near the overlapping area LR of the first embroidery area and the next (i.e., the second) embroidery area in the embroidery sequence, and then performs a panel operation for providing a shooting instruction. Each marker 110 may be an adhesive sheet with a mark on one side (e.g., an upper surface) of a base material sheet that may be relatively thin and white. The base material sheet has transparent adhesive applied on the other side (e.g., a lower surface) thereof. Thus, the marker 110 can be adhered to a workpiece C. Subsequent to step S23, the controller 2 waits for receiving the shooting instruction (e.g., NO in step S24).

If the controller 2 determines that the shooting instruction has been received (e.g., YES in step S24), the controller 2 controls the drive circuits 94 and 95 to move the embroidery hoop 50 to stop at a particular position. When the embroidery hoop 50 is located at the particular position, the overlapping area LR of the previous embroidery area and the next embroidery area and its surrounding portion are positioned within a shooting range of the image sensor 57. The controller 2 then controls the image sensor 57 to capture an image within the shooting range to obtain image data representing the captured image. The controller 2 executes image processing on the obtained image data to detect the markers 110 from the image represented by the image data and determines coordinates of the detected markers 110 (e.g., step S25). The detection of the markers 110 and the coordinate determination of the markers 110 may be implemented using a known method. More specifically, for example, the Hough transform, may be used for calculating two-dimensional coordinates of each marker 110 in the image coordinate system that is applied for the image captured by the image sensor 57. Thereafter, the two-dimensional coordinates in the image coordinate system are transformed into three-dimensional coordinates in the world coordinate system. In the illustrative embodiment, the transformation relationship between the embroidery coordinate system and the world coordinate system are determined in advance. Thus, the coordinates of each marker 110 in the embroidery coordinate system are calculated based on the three-dimensional coordinates in the world coordinate system calculated in the image processing.

Subsequent to step S25, the controller 2 controls the drive circuit 93 to cause the LCD 15 to display a message (e.g., step S26). The message may be, for example, that "Change the position of the embroidery hoop relative to the workpiece with remaining the markers thereon. Then, provide a shooting instruction." In response to such a message, the user changes the position of the embroidery hoop 50 relative to the workpiece C such that a partial pattern to be formed based on the pattern data for the next partial pattern can be formed within the next embroidery area R, and then performs a panel operation for providing a shooting instruction. While the position where the embroidery hoop 50 holds the workpiece C is changed, the positions of the markers 110 relative to the workpiece C are not changed. Subsequent to step S26, the controller 2 waits for receiving the shooting instruction (e.g., NO in step S27). If the controller 2 determines that the shooting instruction has been received (e.g., YES in step S27), similar to step S25, the controller 2 controls the image sensor 57 to capture an image in the shooting area and calculates coordinates of each marker 110 in the embroidery coordinate system (e.g., step S28).

Subsequent to step S28, the controller 2 corrects the partial pattern data for the next partial pattern in the embroidery sequence using the coordinates of the markers 110 calculated in step S25 and step S28 (e.g., step S29). The controller 2 corrects the partial pattern data using, for example, a known method. Subsequent to step S29, the routine proceeds to step S20. In step S20, the controller 2 waits for receiving a start instruction (e.g., NO in step S20). If the controller 2 determines that the start instruction has been received (e.g., YES in step S20), the controller 3 controls the sewing unit 30 and the holder moving unit 40 to form a partial pattern on the workpiece C based on the partial pattern data corrected in step S29 (e.g., step S21). If the controller 2 determines that the embroidering based on the pattern data has been completed, that is, the embroidering based on all pieces of the partial pattern data of the embroidery pattern in the embroidery sequence has been completed (e.g., YES in step S22), the controller 2 ends the main processing.

The needle bar 6 is an example of the claimed needle bar. The sewing unit 30 is an example of the claimed sewing unit. The holder 43 is an example of the claimed attachment unit. The holder moving unit 40 is an example of the claimed moving unit. The controller 2 is an example of the claimed controller. The controller 2 that executes step S2 is an example of the claimed size obtainment. The controller 2 that executes step S4 is an example of the claimed pattern obtainment. The controller 2 that executes step S6 is an example of the claimed repeat number determination. The controller 2 that executes step S18 or S34 is an example of the claimed pattern data generation. The controller 2 that executes step S21 is an example of the claimed embroidery control. The controller 2 that executes step S3 is an example of the claimed width obtainment. The controller 2 that executes step S7 is an example of the claimed size determination. The controller 2 that executes step S8 is an example of the claimed selection. The controller 2 that executes step S1 is an example of the claimed area size obtainment. The controller 2 that executes step S17 is an example of the claimed pattern size determination. The controller 2 that executes step S31 is an example of the claimed area specification.

According to the illustrative embodiment, the sewing machine 1 may generate pattern data for a rectangular frame embroidery pattern to be embroidered by automatically adjusting a layout of a first unit pattern E1 and a second unit pattern E2 in accordance with the size of an embroidery pattern. Further, the sewing machine 1 may generate pattern data for a rectangular frame embroidery pattern to be embroidered having an arbitrary size in which a first unit pattern E1 and a second unit pattern E2 are laid out with more simple operation as compared with a known operation. The sewing machine 1 may form an embroidery pattern on a workpiece C held by the embroidery hoop 50 based on the generated pattern data.

Each of the first unit pattern E1 and the second unit pattern E2 is represented by a single continuous line. The second unit pattern E2 has the start point SP2 and the end point EP2. The second unit pattern E2 is enclosed in the rectangle P2. The start point SP2 and the end point EP2 are located on respective two sides of the rectangle P1 opposite to each other. The first unit pattern E1 has the start point SP1 and the end point EP1. The first unit pattern E1 is enclosed in the rectangle P1. The start point SP1 and the end point EP1 are located on respective two sides of the rectangle P1 perpendicular to each other. The controller 2 generates pattern data for an embroidery pattern to be embroidered that is represented by a single continuous line and in which adjacent first and second unit patterns E1 and E2 are connected to each other using connecting lines and adjacent second unit pattern E2 are connected to each other using connecting lines (e.g., step S18 or S34). Consequently, the sewing machine 1 may form, on a workpiece, an embroidery pattern represented by a single continuous line. Such an embroidery pattern may enable the sewing machine 1 to take a shorter time to complete embroidery of the whole embroidery pattern and may require less steps in finishing (e.g., cutting unnecessary thread extending from the end of the embroidery pattern) as compared with an embroidery pattern that may require thread cutting in the middle of embroidering, if both of the embroidery patterns are embroidered by the respective sewing machines having the same number of needles.

In a case where adjacent first and second unit patterns E1 and E2 are spaced from each other and adjacent second unit patterns E2 are spaced from each other, the controller 2 connects therebetween using connecting lines CL to generate pattern data for an embroidery pattern to be embroidered represented by a single continuous line (e.g., steps S14 and S18, or steps S48 and S34). Although adjacent unit patterns are spaced from each other, the sewing machine 1 may thus generate such pattern data for the embroidery pattern to be embroidered that is represented by a single continuous line by automatically connecting, using connecting lines, between adjacent first and second unit patterns E1 and E2 and between adjacent second unit patterns E2.

The controller 2 lays out the unit patterns with ends of adjacent unit patterns overlapping each other. More specifically, for example, the controller 2 lays out the first and second unit patterns E1 and E2 such that ends of adjacent first and second unit patterns E1 and E2 overlap each other and ends of adjacent second unit pattern E2 overlap each other. Thus, the controller 2 generates pattern data for an embroidery pattern to be embroidered that is represented by a single continuous line (e.g., steps S11 and S18, steps S38 and S34, or steps 43 and S34). The sewing machine 1 may thus generate pattern data for the embroidery pattern to be embroidered that is represented by a single continuous line by automatically laying out the first unit pattern E1 and the second unit pattern E2 with ends of adjacent unit patterns overlapping each other.

The controller 2 obtains the width PH of a target side portion 62 (e.g., step S3). The width PH is perpendicular to the dimension of the target side portion 62 in the length direction. The controller 2 determines, based on the width PH of the target side portion 62 obtained in step S3, the size of the first unit pattern E1 to be laid out in each of the corner portions 61 adjacent to the target side portion 62. In other word, the controller 2 determines the size of the first unit pattern E1 by assigning the dimensions W1 and H1 of the perpendicular sides of the rectangle P1 a value equal to the width PH (e.g., step 7). Further, the controller 2 determines, based on the width PH of the target side portion 62 obtained in step S3 and the second unit pattern repeat number determined in step S6, the size of the second unit pattern E2 to be repeatedly laid out in the target side portion 62 (e.g., step S7). The controller 2 generates pattern data for an embroidery pattern to be embroidered in which the first unit pattern E1 that has been obtained in step S4 and has the size determined in step S7 is laid out in each of the corner portions 61 adjacent to the target side portion 62 and the second unit pattern E2 that has been obtained in step S4 in the target side portion 62 is repeatedly laid out as many as the second unit pattern repeat number that has been determined in step S6 (e.g., step S18). The sewing machine 1 may thus determine the sizes of the first unit pattern E1 and the second unit pattern E2 based on the width PH obtained in step S3. Consequently, the sewing machine 1 may offer the user a higher degree of flexibility in size of the embroidery pattern as compared with a case where the width PH is constant.

In one example, the controller 2 divides the length of the target side area 62 by the width PW of the second unit pattern E2 and rounds down the obtained value to the nearest integer value where the width PW is determined using a ratio of the dimension of the second unit pattern E2 in the second direction to the width PH of the target side portion 62 obtained in step S3 (hereinafter, referred to as the ratio condition). The controller 2 then determines the obtained integer value as the second unit pattern layout number in the target side area 62 (e.g., step S6). The controller 2 divides the length L3 or L4 of the target side portion 62 by the second unit pattern repeat number determined in step S6, and assigns the dimension PW of the second unit pattern E2 to be repeatedly laid out in the target side portion 62 the value obtained by the division (e.g., step S7). The sewing machine 1 may thus automatically determine the second unit pattern repeat number in each of the side portions 62 and the width PW suitable for generating pattern data for an embroidery pattern to be embroidered that is represented by a single continuous line by automatically laying out the first unit pattern E1 and the second unit pattern E2 with ends of adjacent unit patterns overlapping each other. The sewing machine 1 may determine the size of the second unit pattern E2 by changing the size of the second unit pattern E2 obtained in step S4 using respective different ratios for the width PW (i.e., the dimension of the second unit pattern E2 in the first direction) and the dimension of the second unit pattern E2 in the second direction.

In another example, on the ratio condition, the controller 2 divides the length of the target side portion 62 by the dimension PW and rounds up or rounds off the value obtained by the division to the nearest integer value. The controller 2 then determines the obtained integer value as the second unit pattern repeat number in the target side portion 62 (e.g., step S6). The controller 2 divides the length of the target side portion 62 by the second unit pattern repeat number determined in step S6, and assigns the dimension PW of the second unit pattern E2 to be repeatedly laid out in the target side portion 62 the value obtained by the division. The sewing machine 1 may thus automatically determine the second unit pattern repeat number in each of the side portions 62 and the width PW suitable for generating pattern data for an embroidery pattern to be embroidered that is represented by a single continuous line by automatically laying out the first unit pattern E1 and the second unit pattern E2 with ends of adjacent unit patterns overlapping each other. The sewing machine 1 may determine the size of the second unit pattern E2 by changing the size of the second unit pattern E2 obtained in step S4 using respective different ratios for the width PW (i.e., the dimension of the second unit pattern E2 in the first direction) and the dimension of the second unit pattern E2 in the second direction.

In still another example, on the ratio condition, the controller 2 divides the length of the target side portion 62 by the dimension PW, rounds up or rounds off the value obtained by the division to the nearest integer value, and then determines the obtained integer value as the second unit pattern repeat number in the target side portion 62. In addition to this, the controller 2 divides the length of the target side area 62 by the width PW of the second unit pattern E2 and rounds down the obtained value to the nearest integer value. The controller 2 then determines the obtained integer value as the second unit pattern layout number in the target side area 62 (e.g., step S6). The controller 2 determines the width PW corresponding to each of the second unit pattern repeat numbers determined in step S6 (e.g., step S7). The controller 2 selects an appropriate combination from the combinations of the second unit pattern repeat numbers and the sizes of the second unit pattern E2 to be laid out in the target side portion 62 (e.g., step S8). The appropriate combination may a combination that the value Z that is obtained by dividing the first ratio R1 by the second ratio E2 is closer to 1 (one) than the other. The controller 2 lays out the first unit pattern E1 that has been obtained in step S4 and has the size determined in step S7, in each of the corner portions 61 adjacent to the target side portion 62. The controller 2 generates pattern data for an embroidery pattern in which the second unit pattern E2 that has been obtained in step S4 and has the size determined in step S7 is repeatedly laid out in the target side portion 62 as many as the second unit pattern repeat number selected in step S8. The sewing machine 1 may thus automatically determine the second unit pattern repeat number and the width PW in consideration given to a ratio between the first ratio and the second ratio relative to the reference side of the second unit pattern E2 obtained in step S4.

The controller 2 obtains the size of the embroidery area R defined inside the embroidery hoop 50 (e.g., step S1). The controller 2 then determines whether the embroidery pattern can be laid out within the embroidery area R having the size obtained in step S1 (e.g., step S17). If the controller 2 determines the embroidery pattern cannot be laid out within the embroidery area (e.g., NO in step S17), the controller 2 specifies a combined area in which a plurality of embroidery areas are laid out with adjacent embroidery areas partially overlapping each other. The combined area is larger in size than the embroidery pattern (e.g., step S31). The controller 2 lays out the embroidery area in the combined area CR, and generates, with respect to each of the embroidery areas R consisting of the combined area CR, partial pattern data for a partial pattern of the embroidery pattern to be embroidered. That is, the controller 2 generates pattern data for the embroidery pattern to be embroidered including the plurality of pieces of the partial pattern data (e.g., step S34). Each partial pattern of the embroidery pattern can be laid out within a corresponding embroidery area R. Consequently, even if the embroidery pattern to be formed on a workpiece is larger in size than a single embroidery area, the sewing machine 1 may automatically generate a plurality of pieces of partial pattern data that may be suitable for repeatedly forming partial patterns of the embroidery pattern on the workpiece C by changing the position of the embroidery hoop 50 relative to the workpiece C.

If none of the overlapping areas LR overlaps a joint of adjacent second unit patterns E2 of the embroidery pattern laid out in the combined area CR (e.g., NO in step S32), the controller 2 may reduce the second unit pattern repeat number in the target side portion 62 (e.g., step S46). In such a case, the controller 2 connects, using connecting lines, between adjacent first and second unit patterns E1 and E2 and between adjacent second unit patterns E2 (e.g., step S48), and generates a plurality of pieces of partial pattern tata to generate pattern data for an embroidery pattern to be embroidered that is represented by a single continuous line (e.g., step S34). The sewing machine 1 may thus automatically reduce the number of second unit patterns E2 to be included in the embroidery pattern and connect the adjacent second unit patterns E2 using connecting lines such that each of the overlapping areas LR overlaps one of joints of the embroidery pattern.

If none of the overlapping areas LR overlaps a joint of adjacent second unit patterns E2 of the embroidery pattern laid out in the combined area CR (e.g., NO in step S32), the controller 2 may increase the second unit pattern repeat number in the target side portion 62 (e.g., step S36). The controller 2 determines again the width PW based on the second unit pattern repeat number determined in step S36 (e.g., step S37). The controller 2 lays out the first unit pattern E1 that has been obtained in step S4 and has the size determined in step S37, in each of the corner portions 61 adjacent to the target side portion 62. The controller 2 then lays out the second unit pattern E2 that has been obtained in step S4 and has the size determined in step S37, in the target side portion 62 as many as the second unit pattern repeat number determined in step S36 (e.g., step S38). The controller 2 generates pattern data for the embroidery pattern to be embroidered designed in step S38 (e.g., step S34). The pattern data includes a plurality of pieces of partial pattern data for respective partial patterns constituting the embroidery pattern to be embroidered. The sewing machine 1 may thus automatically increase the number of second unit patterns E2 to be included in the embroidery pattern and adjust the size of the second unit pattern E2 such that each of the overlapping areas LR overlaps one of joints of the embroidery pattern.

If none of the overlapping areas LR overlaps a joint of adjacent second unit patterns E2 of the embroidery pattern laid out in the combined area CR (e.g., NO in step S32), the controller 2 may reduce the second unit pattern repeat number in the target side portion 62 (e.g., step S41). The controller 2 determines again the width PW based on the second unit pattern repeat number determined in step S41 (e.g., step S42). The controller 2 generates a plurality of pieces of partial pattern data to generate pattern data for an embroidery pattern to be embroidered in which the first unit pattern E1 that has been obtained in step S4 and has the size determined in step S7 are laid out in each of the corner portions 61 adjacent to the target side portion 62 and the second unit pattern E2 that has been obtained in step S4 in the target side portion 62 and has the size determined in step S42 are repeatedly laid out as many as the second unit pattern repeat number that has been determined in step S41 (e.g., step S34). The sewing machine 1 may thus automatically reduce the number of second unit patterns E2 to be included in the embroidery pattern and adjust the size of the second unit pattern E2 such that each of the overlapping areas LR overlaps one of joints of the embroidery pattern.

The controller 2 lays out the first unit pattern E1 and the second unit pattern E2 by, if necessary, rotating the unit patterns, such that vectors, each of which points from the start point to the end point in a first unit pattern E1 or a second unit pattern E2, point in respective directions in accordance with a specified rule (e.g., the vectors circulate clockwise). The sewing machine 1 may thus reduce difficulty in laying out the first unit pattern E1 and the second unit pattern E2 in accordance with the specified rule when the user designs a rectangular frame embroidery pattern.

While the disclosure has been described in detail with reference to the specific embodiment thereof, this is merely an example, and various changes, arrangements and modifications may be made therein without departing from the spirit and scope of the disclosure.

A. In other embodiments, the sewing machine 1 configured to hold an embroidery hoop may have another configuration. For example, the sewing machine 1 may be an industrial sewing machine or a multi-needle sewing machine. The movement mechanism may be configured at least to move the holder 43 in a particular direction and in a direction intersecting the particular direction relative to the needle bar 6. The holder moving unit 40 may be in one piece with the sewing machine 1 and inseparable from the sewing machine 1. The shape and size of the embroidery hoop 50 might not necessarily be limited to the specific example. The embroidery hoop 50 may have, for example, a circular shape or an oval shape. Steps, except steps S20 to S29, of the main processing may be executed by an external device different from the sewing machine 1. The external device may be, for example, a known general-purpose computer or another terminal. In a case where pattern data is generated in the external device, in one example, the generated data may be stored in a storage device such as a memory card. The sewing machine 1 may read the data from the storage device. In another example, the sewing machine 1 may obtain the generated data from the external device via a wired or wireless connection established with the external device. Examples of a non-transitory computer readable medium may include removable readable/writable media, and non-removable storage devices. Examples of the removable readable/writable media may include a magnetic disk, a magneto-optical disk, an optical disk, and a semiconductor memory. Examples of the non-removable storage devices may include a built-in hard disk drive and a solid state drive ("SSD"). Aspects of the disclosure may be implemented by another manner. For example, the aspects may be implemented by a method of generating pattern data or a pattern data generating device.

B. A program including instructions that cause the controller 2 to execute the main processing (refer to FIGS. 3A and 3B) may be only required to be stored in a storage device of the sewing machine 1 before the controller 2 executes the program. Thus, a method for obtaining the program, a route through which the program is obtained, and a device that stores the program may be changed as desired. The program that is executed by the controller 2 may be stored in a storage device such as a flash memory from another device via a cable or wireless communication. Examples of the other device include a general-purpose computer and a server connected via a network.

C. All of the steps of the main process of the sewing machine 1 might not necessarily be executed by the controller 2. Nevertheless, in other embodiments, for example, some or all of the steps may be executed by another electronic device (e.g., an ASIC). In other embodiments, for example, the steps of the main processing may be executed by multiple electronic devices (e.g., multiple CPUs). The steps of the main processing may be executed in a different order. One or more steps may be skipped or added to the main processing if necessary. The scope of the disclosure also includes a configuration in which an operating system operating on the sewing machine 1 executes some or all of the steps of the main processing based on an instruction provided by the controller 2. For example, the following modifications C-1 to C-8 may be added to the main processing.

Figure 9A:
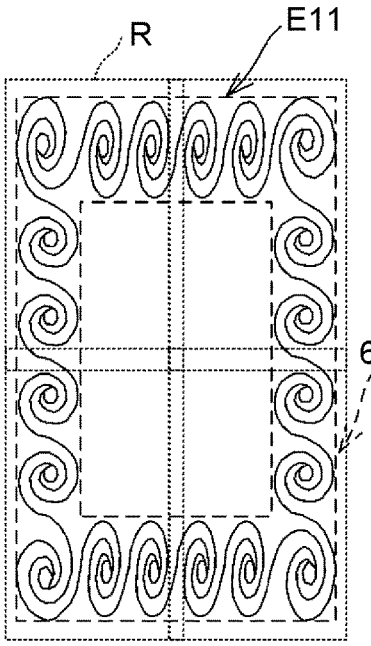
FIGS. 9A to 9I illustrates examples of embroidery patterns to be designed in the main processing in respective alternative embodiments according to one or more aspects of the disclosure.
Figure 9B:
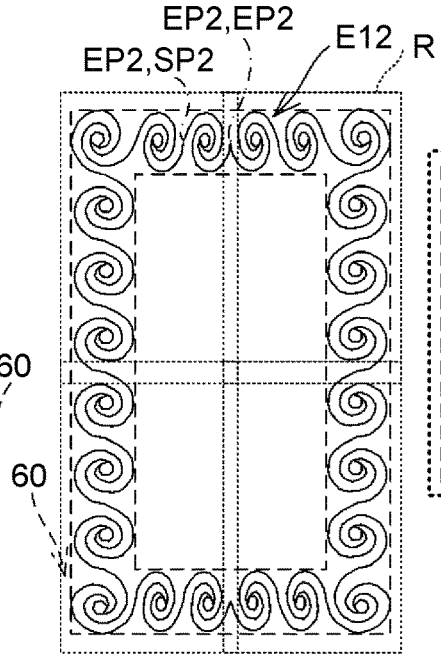

C-1. In other embodiments, for example, in step S3, the dimension of the target side portion in the width direction, i.e., the width PH, may be obtained for each target side portion. In the illustrative embodiment, the widths PH of all of the side portions 62 are assigned with the same value. Nevertheless, in other embodiments, for example, the widths PH of the side portions extending in the X-axis direction may be different from the widths PH of the side portions extending in the Y-axis direction in the embroidery coordinate system. In such a case, in the main processing, the controller 2 may obtain different widths for the side portions extending in the X-axis direction and for the side portions extending in the Y-axis direction, and generate pattern data for, for example, an embroidery pattern E11 (refer to FIG. 9A). The orientations of the first unit pattern and the second unit pattern laid out in the corner portions and in the target side portion, respectively, might not be limited to the specific example. In step S11, S14, S38, S43, or S48, the first unit pattern and the second unit pattern may be oriented as desired. More specifically, for example, as illustrated in FIG. 9B, a first unit pattern and a second unit pattern may be laid out such that a designed embroidery pattern is symmetric with respect to a center line extending in the X-axis direction (e.g., an embroidery pattern E12). In other embodiments, each side portion may have another shape. For example, each side portion may have any polygonal shape or a shape including a curved portion. In other embodiments, each corner portion may have another shape. For example, each corner portion may have a rectangular shape or any polygonal shape. For laying out first and second unit patterns such that ends of adjacent unit patterns overlap each other, the ends of adjacent unit patterns are simply required to substantially overlap each other but might not necessarily overlap each other strictly. In one example, ends of adjacent first and second unit patterns may be spaced from each other by few stitches. In another example, ends of adjacent first and second unit patterns may overlap each other by few stitches. In still another example, ends of adjacent first and second unit patterns may be connected to each other without overlapping or being spaced from each other. The controller 2 may adopt an appropriate one of the methods for determining the size of each of the first and second unit patterns, in accordance with how to overlap the ends of the adjacent unit patterns each other.

Figure 9C:
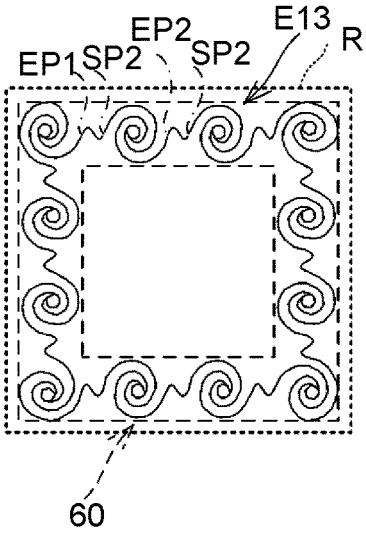
Figure 9D:
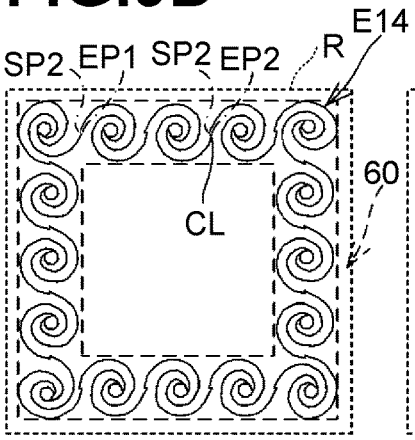

C-2. The connecting line used in step S14 or S18 may be changed as desired. In other embodiments, for example, the connecting line may be formed by another stitch such as a utility stitch or a decorative stitch. More specifically, for example, as illustrated in FIG. 9C, an embroidery pattern E13 includes a first unit pattern E1 and a second unit pattern E2 laid out with leaving a gap therebetween. In such a case, curved connecting lines CL may be used to connect adjacent unit patterns. In one example, the gap amount between adjacent unit patterns may be equal to each other. In another example, the gap amount between adjacent unit patterns may be regularly or irregularly different from each other. In each side portion, the adjacent unit patterns may overlap in the first direction of a second unit pattern E2. In such a case, for example, ends of adjacent first and second unit patterns E1 and E2 and ends of adjacent unit patterns E2 may be connected to each other using connecting lines. FIG. 9D illustrates an embroidery pattern E14 as this example.

Figure 9E:
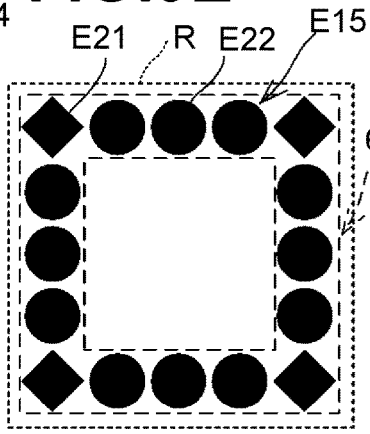
Figure 9F:
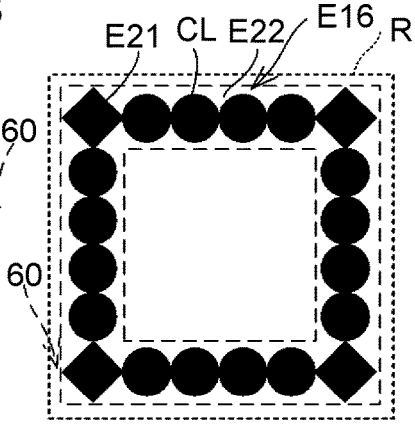
Figure 9G:
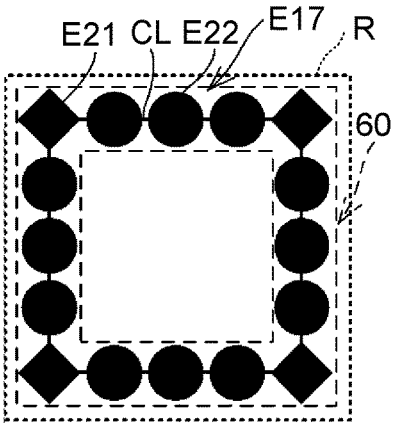

C-3. The shape and size of a first unit pattern and a second unit pattern obtained in step S4 may be changed as desired. The locations of the start point and the end point of each of the first unit pattern and the second unit pattern might not be limited to the specific example. In other embodiments, for example, the figures used as the size reference of the first and second unit patterns may be any figure enclosing a unit pattern or any figure not enclosing a unit pattern. Examples of the figure enclosing a unit pattern include the smallest rectangle that can enclose a unit pattern, a rectangle, a circle, and an oval. The figures used as the size reference might not necessarily be provided in advance for the first unit pattern and the second unit pattern, respectively. The user may assign a figure used as the size reference as required to each of the first unit pattern and the second unit pattern. In one example, in step S4, unit patterns may be obtained from the flash memory 84 as the first and second unit patterns. In another example, in step S4, unit patterns designed by the user through a panel operation may be obtained as the first and second unit patterns. In still another example, unit patterns may be obtained from an external device connected to the sewing machine 1 as the first and second unit patterns. As illustrated in FIGS. 9E, 9F, and 9G, for example, an embroidery pattern may include a first unit pattern E21 having a rhombus shape and a second unit pattern E22 having a circular shape. The first unit pattern E21 and the second unit pattern E22 may be embroidered by fill stitches such as tatami stitches or satin stitches. In one example, as illustrated in FIG. 9E, the controller 2 may create an embroidery pattern E15. In such a case, in step S14, the controller 2 may lay out the first unit pattern E21 and the second unit pattern E22 repeatedly with leaving gaps between adjacent unit patterns. The adjacent unit patterns might not necessarily be connected to each other using a connecting line. In another example, as illustrated in FIG. 9F, the controller 2 may create an embroidery pattern E16. In such a case, in step S11, the controller 2 may change the dimensions of the first unit pattern E21 and the second unit pattern E22 in the first direction appropriately to lay out the first unit pattern E21 and the second unit pattern E22 repeatedly without leaving gaps between adjacent patterns, thereby connecting the adjacent unit patterns directly to each other. In still another example, as illustrated in FIG. 9G, the controller 2 may create an embroidery pattern E17. In such a case, in step S14, the controller 2 may lay out the first unit pattern E21 and the second unit pattern E22 repeatedly with leaving a gap between adjacent unit patterns. The adjacent unit patterns may be connected to each other via respective connecting lines.

Figure 9H:
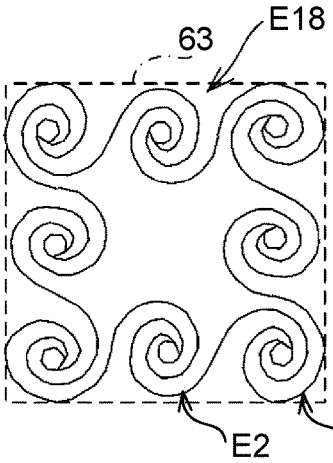

C-4. The detail of step S3 may be changed as desired or step S3 may be skipped. In one example, the controller 2 may assign a predetermined value to the dimension of each side portion in the width direction (e.g., the width PH). In such a case, the predetermined value may be assigned in advance to the dimension of the first and second unit patterns in the second direction to be obtained in step S4. In another example, as illustrated in FIG. 9H, the controller 2 may create an embroidery pattern E18. In such a case, the controller 2 might not assign any value to the dimension of the first and second unit patterns in the second direction. The controller 2 may lay out a first unit pattern E1 and a second unit pattern E2 along edges of the outer outline 63 in accordance with the size of the embroidery pattern without enlarging or reducing the sizes of the first unit pattern E1 and the second unit pattern E2 or after enlarging or reducing the sizes of the first unit pattern E1 and the second unit pattern E2 to predetermined sizes.

C-5. The detail of step S19 may be changed as desired or step S19 may be skipped. In other embodiments, for example, the controller 2 may define a dividing position in each overlapping area (e.g., step S33) regardless of whether or not each of the overlapping areas overlaps one of joints of an embroidery pattern, and generate pattern data including a plurality of pieces of partial pattern data (e.g., step S34). The controller 2 may be configured to, based on the type of a second unit pattern to be embroidered or in response to a user's instruction, determine whether the adjustment processing needs to be executed. In the adjustment processing, the repeat number and size of the second unit pattern to be laid out in each side portion are adjusted such that each of the overlapping areas overlaps one of joints of the embroidery pattern. In such a case, in a case where the second unit pattern is represented by a line (e.g., the second unit pattern E2), the controller 2 may determine that the adjustment processing does not need to be executed. In a case where the second unit pattern is to be formed by fill stitches (e.g., the second unit pattern E22), the controller 2 may determine that the adjustment processing needs to be executed. The adjustment processing may be executed in accordance with one or a combination of the first, second, and third adjustment methods. In a case where an embroidery pattern is embroidered by repeatedly forming partial patterns of the embroidery pattern on a workpiece C, each of a plurality of pieces of partial pattern data for a corresponding partial pattern of the embroidery pattern may only be required to be generated before each piece of partial pattern data is used in embroidering. In other words, all of the plurality of pieces of partial pattern data might not necessarily be generated before embroidering based on the partial pattern data for the first partial pattern in the embroidery sequence is performed.

C-6. In step S6, the controller 2 may calculate the second unit pattern repeat numbers N using one or three or more determination methods and select one from the calculated second unit pattern repeat numbers N. In step S7, the controller 2 may determine the size of the second unit pattern based on the second unit pattern repeat numbers N selected in step S6. In such a case, step S8 may be skipped. The one or more methods to be used in step S6 may be set appropriately. In another example, step S9 may be skipped. In such a case, the controller 2 may execute steps S10 and S11 without relying on the first ratio and the second ratio. In still another example, steps S6 to S11 may be skipped. In such a case, the controller 2 may execute step S12 to S14 subsequent to step S5. In yet another example, the controller 2 may execute a different step among steps S11 and S14 depending on the target side portion or execute the same one of steps S11 and S14 on all of the target side portions. In step S7, S37, and S42, the second ratio may be equal to the first ratio.

C-7. The detail of each of steps S23 to S28 may be changed as desired or steps S23 to S28 may be skipped. For example, in step S29, pattern data may be corrected based on output from an ultrasonic pen or an optical pen.

Figure 9I:
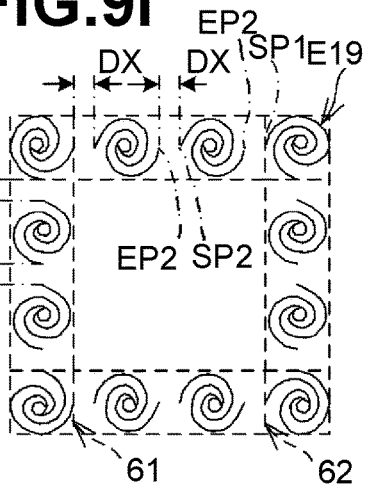
Figure 10:
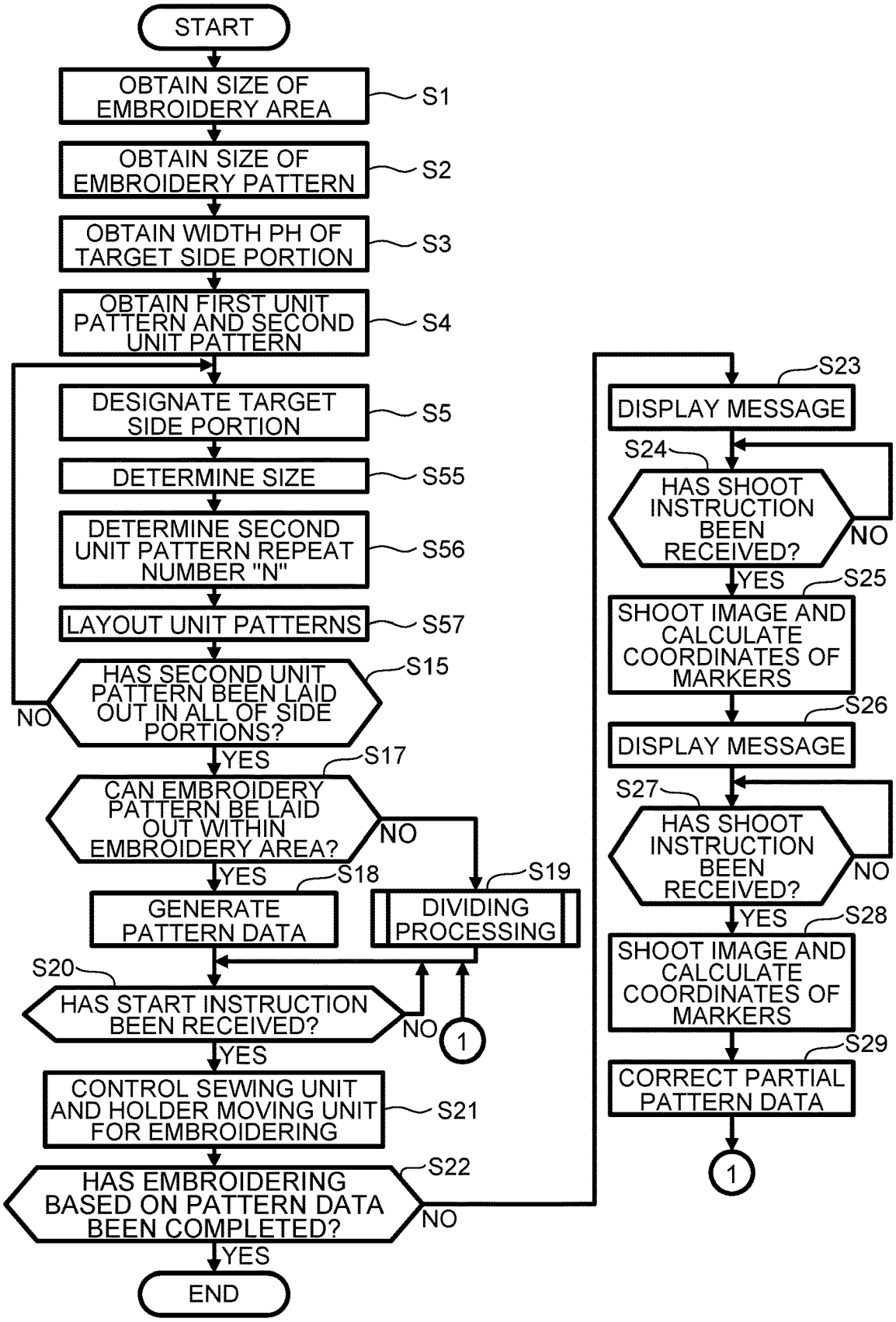
FIG. 10 is a flowchart of main processing to be executed by the controller of the sewing machine in an alternative embodiment according to one or more aspects of the disclosure.

C-8. In other embodiments, for example, the controller 2 may execute main processing of FIG. 10 instead of the main processing of FIGS. 3A and 3B. Common steps have the same step numbers as those of the illustrative embodiment, and the detailed description of the common steps is omitted. As illustrated in FIG. 10, the main processing includes steps S55, S56, and S57 instead of steps S6 to S14 of the main processing of FIGS. 3A and 3B. Hereinafter, steps S55, S56, and S57 will be described in detail assuming that a first unit pattern E1 and a second unit pattern E2 are obtained. The controller 2 determines the respective sizes of the first unit pattern E1 and the second unit pattern E2 based on the width PH of the target side portion 62 (e.g., step S55). The controller 2 assigns the dimensions of the perpendicular sides of the first unit pattern E1 a value equal to the width PH. The controller 2 enlarges or reduces the obtained second unit pattern E2 using a ratio of a dimension H2 to the width PH where the dimension H2 is the dimension of the rectangle P2 in the width direction associated with the second unit pattern E2 obtained in step S4 and the width PH is the width of the target side portion 62 obtained in step S3, thereby determining a dimension PH of the enlarged or reduced second unit pattern E2 in the second direction and a dimension PW of the enlarged or reduced second unit pattern E2 in the first direction. The controller 2 divides the length of the target side portion 62 determined in step S55 by the dimension PW and rounds off the value obtained by the division to the nearest integer value. The controller 2 then determines the obtained integer value as the second unit pattern repeat number in the target side portion 62 (e.g., step S56). The controller 2 lays out the first unit pattern E1 that has been obtained in step S4 and has the size determined in step S55 in each of the corner portions 61 adjacent to the target side portion 62 and the second unit pattern E2 that has the size determined in step S55 in the target side portion 62 repeatedly as many as the second unit pattern repeat number that has been determined in step S56 (e.g., step S57). For example, as illustrated in FIG. 9I, the controller 2 creates an embroidery pattern E19 in which the first unit pattern E1 and the second unit pattern E2 are equally spaced from each other. The controller 2 then executes step S15 and the subsequent steps in a similar manner to the illustrative embodiment. According to this alternative embodiment, the sewing machine 1 may generate pattern data for the embroidery pattern E19 to be embroidered in which the second unit pattern E2 having the size corresponding to the dimension PH of the target side portion 62 is repeatedly laid out in the target side portion 62 as many as the maximum number of the second unit patterns E1 that are laid out in the target side portion 62 in the length direction without being overlapping each other. The sewing machine 1 may then form the embroidery pattern E19 on a workpiece based on the generated pattern data. That is, the size of the second unit pattern E2 may be determined using the same enlargement or reduction ratio applied to the dimension of the second unit pattern E2 in the second direction and the dimension of the second unit pattern E2 in the first direction. The controller 2 may also create another embroidery pattern E15 (refer to FIG. 9E) by executing the main processing of FIG. 10.

What is claimed is:

1. A sewing machine comprising:

a sewing unit including a needle bar, the sewing unit configured to move the needle bar up and down to form stitches on a workpiece;

a moving unit including an attachment unit to which an embroidery hoop holding the workpiece is detachably attached, the moving unit configured to move the attachment unit relative to the needle bar; and a controller configured to control the sewing unit and the moving unit, the controller further configured to perform:

size obtainment including obtaining a size of an embroidery pattern having a rectangular frame shape, the embroidery pattern including four corner portions and four side portions, each of the side portions being positioned between two of the corner portions;

pattern obtainment including obtaining a first unit pattern and a second unit pattern, the first unit pattern being to be laid out in each of the corner portions, the second unit pattern being to be laid out in each of the side portions;

repeat number determination including determining, based on the size of the embroidery pattern obtained in the size obtainment, the number of repeats of the second unit pattern in a target side portion, the target side portion being one of the side portions;

pattern data generation including generating pattern data for the embroidery pattern to be embroidered, the embroidery pattern including the first unit pattern being laid out in each of the corner portions and the second unit pattern being repeatedly laid out in the target side portion as many as the number of repeats of the second unit pattern determined in the repeat number determination; and embroidery control including controlling the sewing unit and the moving unit based on the generated pattern data, thereby forming the embroidery pattern on the workpiece held by the embroidery hoop.

2. The sewing machine according to claim 1, wherein each of the first unit pattern and the second unit pattern is represented by a single continuous line, wherein the first unit pattern is enclosed with a first rectangle and the second unit pattern is enclosed with a second rectangle, wherein the line representing the second unit pattern has a start point and an end point, and the start point and the end point of the second unit pattern are located on two sides of the second rectangle opposite to each other, wherein the line representing the first unit pattern has a start point and an end point, and the start point and the end point of the first unit pattern are located on two sides of the first rectangle perpendicular to each other, and wherein the embroidery pattern represented by the pattern data generated in the pattern data generation is represented by a single continuous line, wherein in the embroidery pattern represented by the pattern data generated in the pattern data generation, adjacent first and second unit patterns are connected to each other and adjacent second unit patterns are connected to each other.

3. The sewing machine according to claim 2, wherein, in the embroidery pattern represented by the pattern data generated in the pattern data generation, adjacent first and second unit patterns are spaced from each other and connected to each other via connecting lines and adjacent second unit patterns are spaced from each other and connected to each other via connecting lines.

4. The sewing machine according to claim 2, wherein, in the embroidery pattern represented by the pattern data generated in the pattern data generation, ends of adjacent first and second unit patterns overlap each other and ends of adjacent second unit patterns overlap each other.

5. The sewing machine according to claim 1, wherein the controller is further configured to perform:

width obtainment including obtaining a dimension of the target side portion in a width direction perpendicular to a length direction in which longer sides of the target side portion extend; and size determination including determining, based on the dimension of the target side portion in the width direction obtained in the width obtainment, a size of the first unit pattern to be laid out in each of adjacent corner portions adjacent to the target side portion, and determining, based on based on the dimension of the target side portion in the width direction obtained in the width obtainment and the number of repeats of the second unit pattern determined in the repeat number determination, a size of the second unit pattern to be repeatedly laid out in the target side portion, and wherein the embroidery pattern represented by the pattern data generated in the pattern data generation includes:

the first unit pattern having been obtained in the pattern obtainment and having the size determined in the size determination, the first unit pattern being laid out in each of the adjacent corner portions; and the second unit pattern having been obtained in the pattern obtainment and having the size determined in the size determination in the target side portion, the second unit pattern being repeatedly laid out in the target side portion as many as the number of repeats of the second unit pattern determined in the repeat number determination.

6. The sewing machine according to claim 5, wherein the repeat number determination further includes:

where the dimension of the second unit pattern in the second direction is determined using a ratio of the dimension of the second unit pattern in the second direction to the dimension of the target side portion in the width direction obtained in the width obtainment, dividing the dimension of the target side portion in the length direction by the dimension of the second unit pattern in the first direction;

rounding down the value obtained by the dividing to the nearest integer value; and determining the obtained integer value as the number of repeats of the second unit pattern to be laid out in the target side portion, and wherein the size determination includes:

dividing the dimension of the target side portion in the length direction by the number of repeats of the second unit pattern in the repeat number determination; and determining the value obtained by the dividing in the size determination as the dimension of the second unit pattern in the first direction to be laid out in the target side portion.

7. The sewing machine according to claim 5, wherein the repeat number determination further includes:

where the dimension of the second unit pattern in the second direction is determined using a ratio of the dimension of the second unit pattern in the second direction to the dimension of the target side portion in the width direction obtained in the width obtainment, dividing the dimension of the target side portion in the length direction by the dimension of the second unit pattern in the first direction;

rounding up or off the value obtained by the dividing to the nearest integer value; and determining the obtained integer value as the number of repeats of the second unit pattern to be laid out in the target side portion, and wherein the size determination includes:

dividing the dimension of the target side portion in the length direction by the number of repeats of the second unit pattern in the repeat number determination; and determining the value obtained by the dividing in the size determination as the dimension of the second unit pattern in the first direction to be laid out in the target side portion.

8. The sewing machine according to claim 5, wherein the repeat number determination further includes:

first determination including:

where the dimension of the second unit pattern in the second direction is determined using a ratio of the dimension of the second unit pattern in the second direction to the dimension of the target side portion in the width direction obtained in the width obtainment, dividing the dimension of the target side portion in the length direction by the dimension of the second unit pattern in the first direction;

rounding up or off the value obtained by the dividing to the nearest integer value; and determining the obtained integer value as the number of repeats of the second unit pattern to be laid out in the target side portion; and second determination including:

where the dimension of the second unit pattern in the second direction is determined using a ratio of the dimension of the second unit pattern in the second direction to the dimension of the target side portion in the width direction obtained in the width obtainment, dividing the dimension of the target side portion in the length direction by the dimension of the second unit pattern in the first direction;

rounding down the value obtained by the dividing to the nearest integer value; and determining the obtained integer value as the number of repeats of the second unit pattern to be laid out in the target side portion, wherein the size determination includes determining the dimension of the second unit pattern in the first direction with respect to each of the numbers of repeats of the second unit patterns determined in the first determination and the second determination, respectively, of the repeat number determination, wherein the controller is further configured to perform selection including selecting an appropriate combination from a plurality of combinations of the numbers of repeats of the second unit pattern and the size of the second unit pattern to be repeatedly laid out, wherein the appropriate combination is a combination that a value that is obtained by dividing a first ratio by a second ratio is closer to one than the other, wherein the first ratio is a ratio of a reference size of the second unit pattern obtained in the pattern obtainment to the dimension of the second unit pattern in the first direction, and the second ratio is a ratio of the reference size of the second unit pattern obtained in the pattern obtainment to the dimension of the second unit pattern in the second direction, and wherein the embroidery pattern represented by the pattern data generated in the pattern data generation includes:

the first unit pattern having been obtained in the pattern obtainment and having the size determined in the size determination, the first unit pattern being laid out in each of the adjacent corner portions; and the second unit pattern having been obtained in the pattern obtainment and having the size corresponding to the combination selected in the selection, the second unit pattern being repeatedly laid out in the target side portion as many as the number of repeats of the second unit pattern corresponding to the combination selected in the selection.

9. The sewing machine according to claim 1, wherein the controller is further configured to perform:

width obtainment including obtaining a dimension of the target side portion in a width direction perpendicular to a length direction in which longer sides of the target side portion extend; and size determination including determining, based on the dimension of the target side portion in the width direction obtained in the width obtainment, a size of the first unit pattern to be laid out in each of adjacent corner portions adjacent to the target side portion and a size of the second unit pattern to be repeatedly laid out in the target side portion, wherein the repeat number determination further includes:

dividing the dimension of the target side portion in the length direction by the dimension of the second unit pattern in the first direction;

rounding down the value obtained by the dividing to the nearest integer value; and determining the obtained integer value as the number of repeats of the second unit pattern to be laid out in the target side portion, and wherein the embroidery pattern represented by the pattern data generated in the pattern data generation includes:

the first unit pattern having been obtained in the pattern obtainment and having the size determined in the size determination, the first unit pattern being laid out in each of the adjacent corner portions; and the second unit pattern having the size determined in the size determination, the second unit pattern being repeatedly laid out in the target side portion as many as the number of repeats of the second unit pattern determined in the repeat number determination.

10. The sewing machine according to claim 1, wherein the controller is further configured to perform:

area size obtainment including obtaining a size of an embroidery area defined inside of the embroidery hoop;

pattern size determination including determining whether the embroidery pattern can be laid out within the embroidery area having the size obtained in the area size obtainment; and area specification including, based on the determination, in the pattern size determination, that the embroidery pattern cannot be laid out within the embroidery area, specifying a combined area including a plurality of embroidery areas, each adjacent embroidery areas overlapping each other to form an overlapping area, the combined area being larger in size than the embroidery pattern, wherein the pattern data generation includes generating a plurality of pieces of partial pattern data of the embroidery pattern to be embroidered laid out in the combined area specified in the area specification, wherein the plurality of pieces of partial pattern data correspond to respective sections of the embroidery pattern.

11. The sewing machine according to claim 10, wherein, based on a determination that the overlapping area does not overlap one of joints of adjacent second unit patterns of the embroidery pattern laid out in the combined area, the repeat number determination includes reducing the number of repeats of the second unit pattern to be laid out in the target side portion, and wherein the embroidery pattern represented by the pattern data generated in the pattern data generation is represented by a single continuous line, wherein in the embroidery pattern represented by the pattern data generated in the pattern data generation, adjacent first and second unit patterns are connected to each other via connecting lines and adjacent second unit patterns are connected to each other via connecting lines.

12. The sewing machine according to claim 10, wherein, based on a determination that the overlapping area does not overlap one of joints of adjacent second unit patterns of the embroidery pattern laid out in the combined area, the repeat number determination includes increasing the number of repeats of the second unit pattern to be laid out in the target side portion, wherein the size determination includes determining again the dimension of the second unit pattern in the first direction based on the number of repeats of the second unit pattern determined in the repeat number determination, and wherein the embroidery pattern represented by the pattern data generated in the pattern data generation includes:

the first unit pattern having been obtained in the pattern obtainment and having the size determined in the size determination, the first unit pattern being laid out in each adjacent corner portion adjacent to the target side portion; and the second unit pattern having been obtained in the pattern obtainment and having the size redetermined in the size determination, the second unit pattern being repeatedly laid out in the target side portion as many as the number of repeats of the second unit pattern determined in the repeat number determination.

13. The sewing machine according to claim 10, wherein, based on a determination that the overlapping area does not overlap one of joints of adjacent second unit patterns of the embroidery pattern laid out in the combined area, the repeat number determination includes reducing the number of repeats of the second unit pattern to be laid out in the target side portion, wherein the size determination includes determining again the dimension of the second unit pattern in the first direction based on the number of repeats of the second unit pattern determined in the repeat number determination, and wherein the embroidery pattern represented by the pattern data generated in the pattern data generation includes:

the first unit pattern having been obtained in the pattern obtainment and having the size determined in the size determination, the first unit pattern being laid out in each adjacent corner portion adjacent to the target side portion; and the second unit pattern having been obtained in the pattern obtainment and having the size redetermined in the size determination, the second unit pattern being repeatedly laid out in the target side portion as many as the number of repeats of the second unit pattern determined in the repeat number determination.

14. A non-transitory computer-readable medium storing computer-readable instructions that, when executed by a computer, cause the computer to perform:

obtaining a size of an embroidery pattern having a rectangular frame shape, the embroidery pattern including four corner portions and four side portions, each of the side portions being positioned between two of the corner portions;

obtaining a first unit pattern and a second unit pattern, the first unit pattern being to be laid out in each of the corner portions, the second unit pattern being to be laid out in each of the side portions;

determining, based on the obtained size of the embroidery pattern, the number of repeats of the second unit pattern in a target side portion that is one of the side portions;

generating pattern data for the embroidery pattern to be embroidered, the embroidery pattern including the first unit pattern being laid out in each of the corner portions and the second unit pattern being repeatedly laid out in the target side portion as many as the determined number of repeats of the second unit pattern.

* * * * *